US009863414B2

(12) United States Patent
Laing et al.

(10) Patent No.: US 9,863,414 B2
(45) Date of Patent: Jan. 9, 2018

(54) HORIZONTAL AND VERTICAL WELL FLUID PUMPING SYSTEM

(71) Applicant: RAISE PRODUCTION, INC., Calgary (CA)

(72) Inventors: Eric Laing, Calgary (CA); Geoff Steele, Calgary (CA); Dan Fletcher, Calgary (CA); Herve Ohmer, Houston, TX (US)

(73) Assignee: RAISE PRODUCTION INC., Calgary, AB (CA)

( * ) Notice: Subject to any disclaimer, the term of this patent is extended or adjusted under 35 U.S.C. 154(b) by 680 days.

(21) Appl. No.: 14/364,506

(22) PCT Filed: Dec. 17, 2012

(86) PCT No.: PCT/CA2012/001156
§ 371 (c)(1),
(2) Date: Jun. 11, 2014

(87) PCT Pub. No.: WO2013/086623
PCT Pub. Date: Jun. 20, 2013

(65) Prior Publication Data

US 2014/0341755 A1 Nov. 20, 2014

Related U.S. Application Data

(60) Provisional application No. 61/570,981, filed on Dec. 15, 2011.

(51) Int. Cl.
*E21B 43/12* (2006.01)
*F04B 47/00* (2006.01)
(Continued)

(52) U.S. Cl.
CPC ..... *F04B 47/00* (2013.01); *E21B 43/121* (2013.01); *E21B 43/128* (2013.01); *E21B 43/14* (2013.01);
(Continued)

(58) Field of Classification Search
CPC ..... F04B 47/00; F04B 23/04; F04B 45/04; F04B 45/043; F04B 45/053; F04B 47/06;
(Continued)

(56) References Cited

U.S. PATENT DOCUMENTS 3,062,153 A 11/1962 Losey
4,257,751 A 3/1981 Kofahl
(Continued)

FOREIGN PATENT DOCUMENTS

CN 201474928V 5/2010
RU 2225938 3/2004
(Continued)

*Primary Examiner* — Yong-Suk Ro
(74) *Attorney, Agent, or Firm* — Bennett Jones LLP

(57) ABSTRACT

A pump system for producing fluids from a reservoir using a well bore having a vertical section with a easing defining an annulus, a transitional section and a horizontal section, and a production tubing having a vertical section and a horizontal section, wherein the system includes a completion with an isolation device in the annulus near the bottom of the vertical section, a gas/liquid separator for receiving produced fluids from the horizontal section, and a vertical lift pump; a continuous flow path from the terminus of the production tubing to the vertical section; a plurality of horizontal pumps in the horizontal section, each having an intake exposed to the reservoir and an outlet in the continuous flow path. The horizontal length of the production tubing is closed to the reservoir except through the horizontal pumps. A method of producing fluids includes isolating a vertical section of a wellbore from a horizontal section; isolating the production tubing from the reservoir; pumping
(Continued)

fluid from the reservoir adjacent a toe segment into a production tubing toe segment and towards the heel segment; and pumping fluid from the reservoir adjacent a heel segment into the production tubing heel segment and towards the vertical section, and pumping fluid up the vertical section to the surface.

8 Claims, 28 Drawing Sheets

(51) Int. Cl.

| | |
|---|---|
| ***E21B 43/14*** | (2006.01) |
| ***F04B 47/06*** | (2006.01) |
| ***F04C 13/00*** | (2006.01) |
| ***E21B 47/00*** | (2012.01) |
| ***E21B 47/06*** | (2012.01) |
| ***F04B 23/04*** | (2006.01) |
| ***F04B 45/04*** | (2006.01) |
| ***F04B 45/053*** | (2006.01) |
| ***F04B 49/06*** | (2006.01) |
| ***F04C 2/08*** | (2006.01) |
| ***F04C 2/107*** | (2006.01) |
| ***F04D 13/08*** | (2006.01) |
| ***F04F 5/00*** | (2006.01) |

(52) U.S. Cl.
CPC ..... *E21B 47/0007* (2013.01); *E21B 47/06* (2013.01); *F04B 23/04* (2013.01); *F04B 45/04* (2013.01); *F04B 45/043* (2013.01); *F04B 45/053* (2013.01); *F04B 47/06* (2013.01); *F04B 49/065* (2013.01); *F04C 2/084* (2013.01); *F04C 2/107* (2013.01); *F04C 13/008* (2013.01); *F04D 13/08* (2013.01); *F04F 5/00* (2013.01)

(58) Field of Classification Search
CPC .... F04B 49/065; E21B 43/121; E21B 43/128; E21B 43/14; E21B 47/007; E21B 47/06; F04V 2/094; F04C 2/084; F04C 2/107; F04C 13/008; F04D 13/08
See application file for complete search history.

(56) References Cited

U.S. PATENT DOCUMENTS

| | | | | |
|---|---|---|---|---|
| 4,360,320 | A | 11/1982 | Owen | |
| 4,439,113 | A | 3/1984 | Owen | |
| 4,580,952 | A | 4/1986 | Eberle | |
| 5,207,096 | A | 5/1993 | Castel et al. | |
| 5,445,356 | A | 8/1995 | Walsh et al. | |
| 5,447,201 | A | 9/1995 | Mohn | |
| 5,522,463 | A | 6/1996 | Barbee | |
| 5,746,255 | A | 5/1998 | Walsh et al. | |
| 5,842,839 | A | 12/1998 | Walsh et al. | |
| 6,085,366 | A | 7/2000 | Pondelick et al. | |
| 6,119,780 | A | 9/2000 | Christmas | |
| 6,619,402 | B1 * | 9/2003 | Amory ..... | E21B 43/121 166/105 |
| 6,973,973 | B2 | 12/2005 | Howard et al. | |
| 7,252,148 | B2 | 8/2007 | Traylor | |
| 2011/0209879 | A1 | 9/2011 | Quigley et al. | |
| 2012/0012333 | A1 | 1/2012 | Quigley et al. | |

FOREIGN PATENT DOCUMENTS

| | | |
|---|---|---|
| RU | 94628 | 5/2010 |
| WO | 8201738 | 5/1982 |

* cited by examiner

1 - Vertical chamber fluid free surface
2 - Vertical artificial lift system (eg. pump and rode to surface)
3 - Vertical A/L system intake
4 - Horizontal chamber fluid free surface
PTv - Pressure transmitter measuring static annular vertical chamber pressure
PTh - Pressure transmitter measuring static annular horizontal chamber pressure
Pa1 - Upper annulus static pressure
Pa2 - Lower annulus static pressure

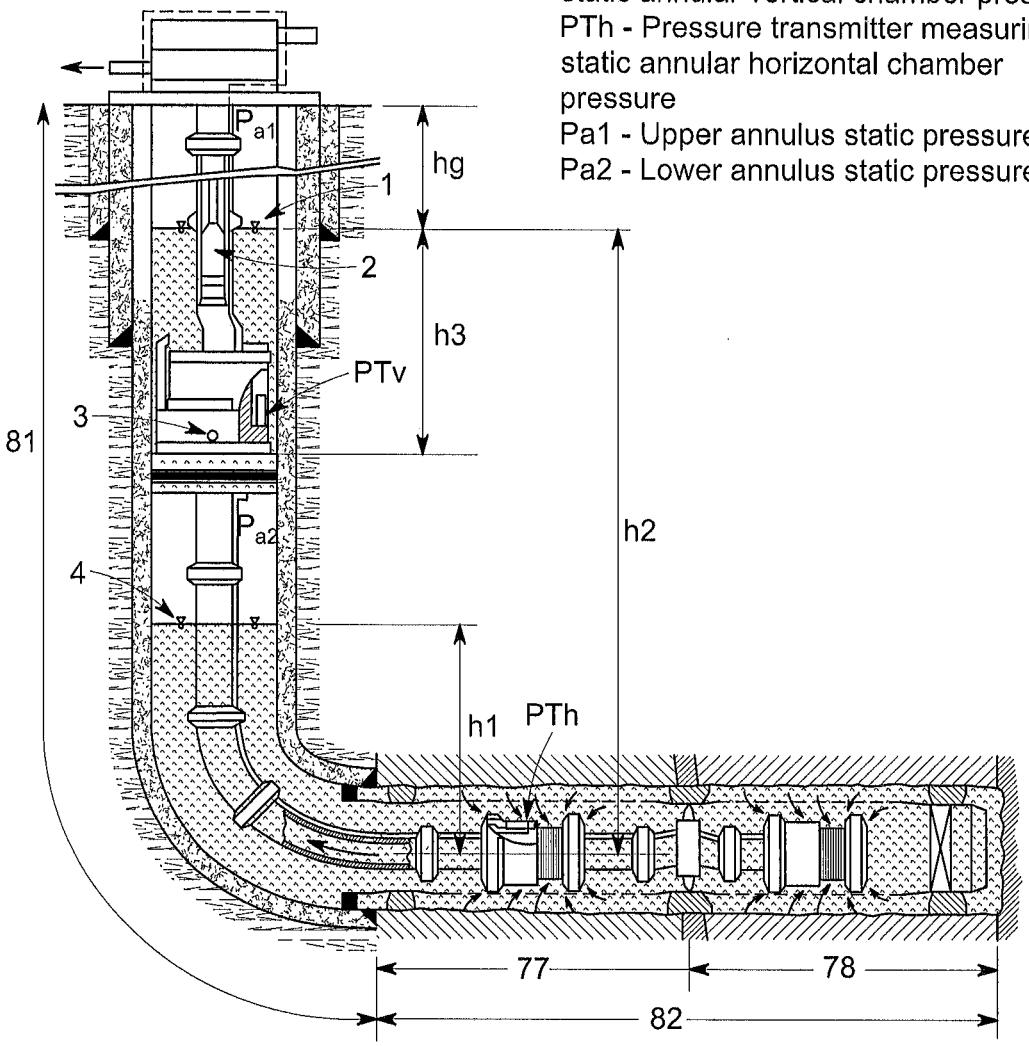

FIG. 17

HORIZONTAL AND VERTICAL WELL FLUID PUMPING SYSTEM

FIELD OF THE INVENTION

The present invention relates to a well fluid pumping method and system for producing fluids from a wellbore having at least one substantially vertical section and at least one substantially horizontal section.

It is well known in the art of oil and gas production to use pumps landed in the deepest point of a vertically oriented wellbore, or at the heel of the horizontally oriented interval, to move produced liquids from the reservoir to surface. Traditional vertical artificial lift solutions are well known. Various mechanical pumps such as rod pumps, progressive cavity pumps, electric submersible pumps or hydraulically actuated pumps are in widespread use in the oil and gas industry.

There are many benefits to utilizing a horizontal drilling and completions strategy for completing and producing wellbores. A horizontal wellbore can maximize the exposure of the reservoir by creating a hole which follows the reservoir thickness. A typical horizontal wellbore plan also allows for the wellbore trajectory to transversely intersect the natural fracture planes of the reservoir and thereby maximize the efficiency of fracture stimulation and proppant placement and therefore total productivity.

The primary advantage of a horizontally oriented wellbore is the exposure of a greater segment of the reservoir to the wellbore using a single vertical parent borehole, than is possible using several vertically oriented wellbores drilled into the same reservoir. However, in order to maximize this advantage, well performance must be proportional to the exposed length of reservoir in the producing well. As is commonly known in the industry, the relationship of well exposure to well productivity is not directly proportional in horizontally oriented wellbores.

Generally, the production of horizontal wellbores is exploited using reservoir energy until the initial production is obtained. If the reservoir drive is insufficient or quickly dwindles, production from the horizontal segment of the wellbore is drawn down utilizing a single pump inlet landed at or near the heel of the horizontal wellbore. Alternately, other conventionally known lift solutions such as plunger lift and gas lift are used to manage the back pressure on the formation through the vertical and transitional section of the wellbore. Other services such as jet pumps are used in an intermittent capacity to unload or clean out the horizontal wellbore section.

Conventional means for producing a horizontal well do not influence the reservoir much past the heel. FIG. 1 (Prior Art) depicts a representative horizontal wellbore with a single conventional pump disposed in the vertical section of the wellbore. In this case, the drawdown is localized to the region in the heel of the wellbore. The drawdown pressure is also limited to the theoretical vapor pressure of the fluid being pumped.

In a gas well having a horizontal wellbore, there are many potential challenges which may lead to poor well performance. Gas wells are often challenged by in-situ water production, water recovery from fracture stimulations or active water sources, condensates or natural gas liquids. For a gas reservoir to lift the liquids associated with production, it must have sufficient energy to generate mist flow in the horizontal producing leg of the wellbore. Very often, a substantial gas rate is required to lift a relatively small daily fluid volume, and cannot be sustained in long-term production.

Because most horizontal gas wells do not have the required transport velocities they are often subject to transitional flows such as stratified and slug type flows. This type of production regime is highly inefficient since slugs form and break along the horizontal pipe and the gas breaks through and then intermittently migrates along the horizontal and through the liquid head towards the surface, causing an inconsistent differential pressure profile between the near well bore and the horizontal producing leg.

A producing oil well, either horizontal or vertical, transitions through its bubble point during its producing life. When this occurs, gas escapes from solution and there exists at least two separate phases (gas and oil) in the reservoir, resulting in a gas cap drive. The efficient production of these types of reservoirs is accomplished by carefully managing the depletion of the gas cap drive, which may be monitored by the produced gas/liquid ratios. In a traditional free-flowing gas cap drive well, the fluids will be mobilized by the gas drive and follow the path of least resistance in the journey towards the surface. This results in a disproportionate production of the reservoir in the vicinity of the heel of the wellbore. As shown in FIG. 2 (Prior Art), the onset of premature depletion at the heel is exacerbated by the single drawdown location in the wellbore located near the heel. This production regime is present throughout the producing life until such a time as the heel becomes depleted and the gas cap drive breaks through near the heel, shown schematically in FIG. 3 (Prior Art). Gas cap drive break through results in elevated gas/liquid ratios. This scenario can and often does result in significant damage to the vertical pumping solution due to gas locking and gas pounding. Eventually the gas drive will deplete, leaving unproduced fluid (reserves) in the reservoir space further from the heel, thus leading to low recovery factors and stranded oil in the reservoir.

There remains a need for a robust pumping method and system to remove liquids from wellbores of different geometries, including horizontal segments, which addresses hydraulic issues that pertain to these types of wells in an effort to reach a well performance near proportional to well exposure to the reservoir.

SUMMARY OF THE INVENTION

In general terms, embodiments of the present invention comprise a method and system of producing fluids from a wellbore which intersects a formation, the wellbore having a vertical section, a horizontal section and a transition section.

In one aspect, the invention may comprise a pump system for producing fluids from a reservoir using a wellbore having a vertical section with a casing defining an annulus, a transitional section and a horizontal section, and a production tubing having a vertical section and a horizontal section, the system comprising:

(a) a completion near the bottom of the vertical section or in the transitional section of the wellbore comprising an isolation device in the annulus, a gas/liquid separator for receiving produced fluids from the horizontal section, and a vertical lift pump having an intake in the annulus above the isolation device; and (b) a continuous flow path from the terminus of the production tubing to the vertical section;

(c) at least one horizontal pump in the horizontal section having an intake exposed to the reservoir and an outlet in the continuous flow path;

(d) wherein the horizontal section of the production tubing is closed to the reservoir except through the at least one horizontal pump.

In one embodiment, the production tubing horizontal section comprises a heel segment and a toe segment, and at least one intermediate segment therebetween, wherein each segment comprises a horizontal pump. In one embodiment, each segment is isolated from an adjacent segment by an isolation device in the annulus.

In one embodiment, the system may further comprise a control system for controlling pump system flow rates of each horizontal pump and the vertical lift pump. The control system may comprise a surface mounted device to firstly control the annular fluid height in the vertical section above the isolation device, and secondly to manage the inflow conditions along the horizontal section.

In another aspect, the invention may comprise a pump system for producing fluids from a reservoir using a wellbore having a vertical section with a casing defining an annulus, and a horizontal section, and a production tubing having a vertical section and a horizontal section defining a continuous flow path from its terminus to the vertical section, the system comprising:

(a) a plurality of horizontal pumps operating in parallel in the horizontal section, each having an intake exposed to the reservoir and an outlet in the horizontal section flow path;

(b) wherein the continuous flow path is closed to the reservoir except through the horizontal pumps.

In another aspect, the invention may comprise a method of producing fluids from a reservoir using a wellbore having a vertical section and a horizontal section, and production tubing having a vertical section and a horizontal section comprising at least a heel segment and a toe segment, wherein the vertical section of the wellbore is isolated from the horizontal section;

(a) isolating the production tubing from the reservoir;

(b) pumping fluid from the reservoir adjacent the toe segment into the production tubing toe segment and towards the heel segment;

(c) pumping fluid from the reservoir adjacent the heel segment into the production tubing heel segment and towards the vertical section; and (d) pumping fluid in the vertical section to the surface.

In one embodiment, the method comprises the further step of separating liquids and gases in the vertical section, and pumping liquids up the vertical length to the surface, leaving gases in the annulus.

In one embodiment, the production tubing horizontal section has three or more segments comprising a heel segment, a toe segment, and one or more intermediate segments, and fluid is pumped from the reservoir adjacent each segment of the production tubing into that segment. The pump rate of the pumps in each segment of the horizontal length may be varied for pressure control in the reservoir along the length of the horizontal section. Each segment may be separated from an adjacent segment by an isolation device in the annulus.

In one embodiment, the pump rate in each of the toe segment and the heel segment, and any intermediate segment, and in the vertical section may be independently varied in response to flow and pressure conditions in each section of horizontal segment.

In one embodiment, the method further comprises the steps of measuring, acquiring and processing downhole production information collected at selected locations in the horizontal section and in the vertical section, and adjusting pump rates in at least one of the vertical section, toe segment, or heel segment to optimize the horizontal wellbore productivity over its whole length.

In yet another aspect, the invention comprises a diaphragm pump system for use in removing fluids from a wellbore, comprising:

(a) at least one pumping unit having a rigid housing, a central internal mandrel and a flexible diaphragm disposed within the housing, wherein the diaphragm defines a sealed activation chamber with the rigid housing and an internal production chamber, and wherein the production chamber comprises a fluid inlet and a fluid outlet;

(b) an activation conduit in fluid communication with the activation chamber;

(c) an exhaust conduit in fluid communication with the activation chamber;

(d) a production conduit in fluid communication with the production chamber fluid outlet; and (e) at least one check valve associated with either or both of the production chamber fluid inlet or fluid outlet.

In one embodiment, there is a check valve associated with each of the fluid inlet and the fluid outlet, and each check valve operates independently of each other.

In one embodiment, the internal mandrel defines a fluid production port and a hollow interior which communicates with the production conduit.

In one embodiment, the pump system further comprises surface storage or source of pressurized activation fluid in fluid communication with the activation conduit and an activation fluid directional control valve for controlling the flow of activation fluid into the activation conduit. The surface storage may be in fluid communication with the exhaust conduit, and the activation fluid is circulated in a closed system. Alternatively, the exhaust conduit may vent to the atmosphere or the exhausted activation fluid be otherwise used, in an open system. The activation fluid may comprise a hydraulic activation fluid or an activation gas such as carbon dioxide, natural gas, or nitrogen.

The methods of the present invention may be applied in conjunction with unconventional or enhanced oil recovery techniques, such as steam-assisted gravity drainage, miscible flood, steam (continuous or cyclic), gas or water injection.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows:

FIG. 17 is an alternate view of the embodiment of FIG. 16.

DETAILED DESCRIPTION OF PREFERRED EMBODIMENTS

The invention relates to pump method and system for producing fluids from wellbores having a vertical section and a horizontal section. When describing the present invention, all terms not defined herein have their common art-recognized meanings. To the extent that the following description is of a specific embodiment or a particular use of the invention, it is intended to be illustrative only, and not limiting of the claimed invention.

Figure 1:
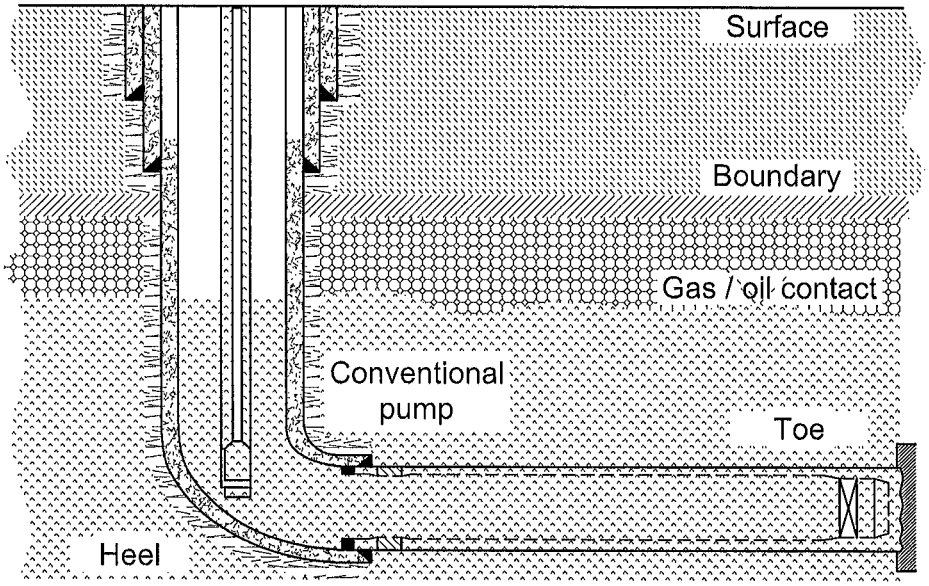
FIG. 1 PRIOR ART
FIG. 1 (Prior Art) Schematic of horizontal wellbore depicting gas/oil contact, formation boundaries and single point of drawdown vertically disposed pumping solution FIG. 2 (Prior Art) Schematic of horizontal wellbore depicting the onset of depletion at the heel due to single point of drawdown/entry at the heel.
Figure 2:
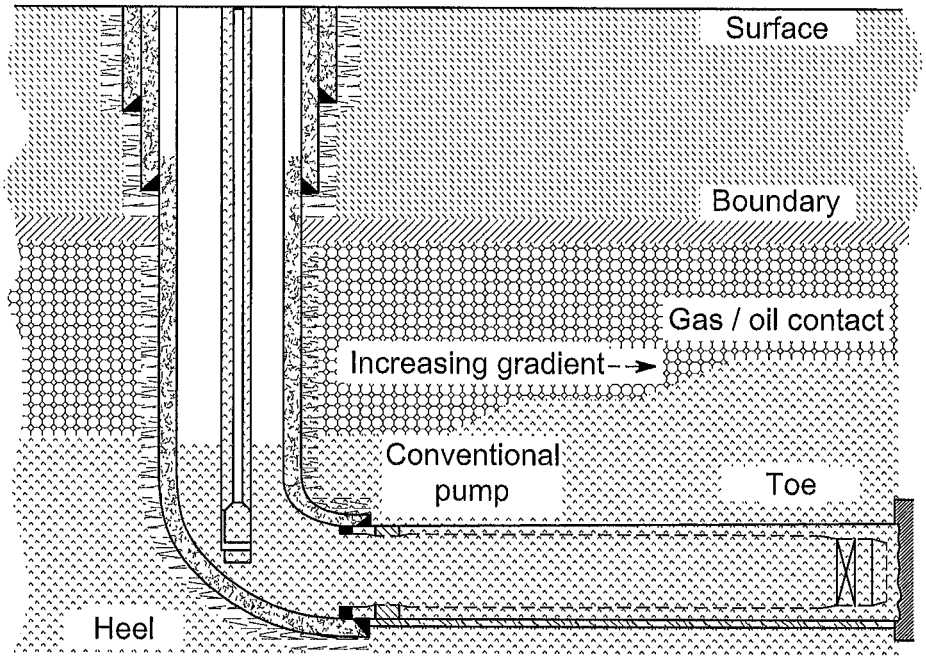
FIG. 2 PRIOR ART
Figure 3:
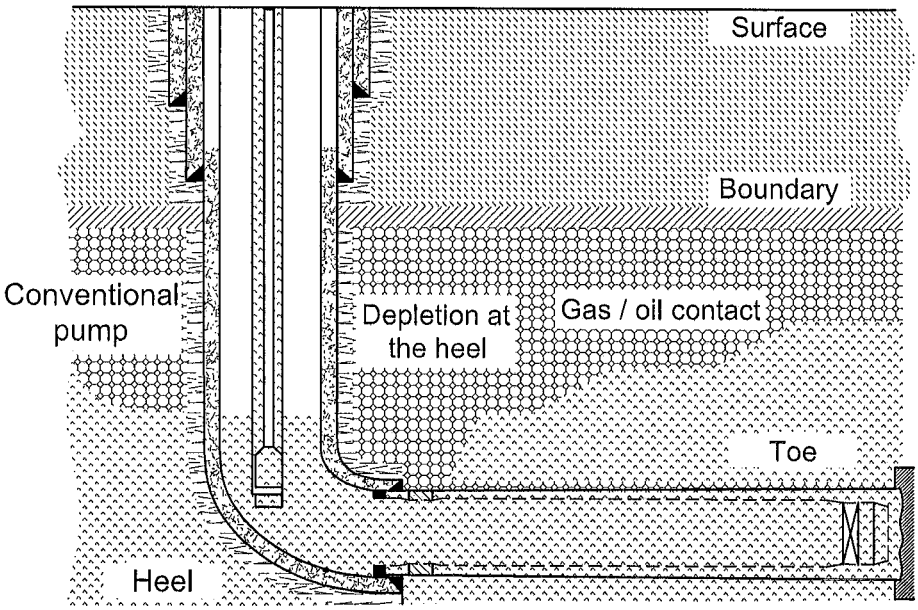
FIG. 3 PRIOR ART
FIG. 3 (Prior Art) Schematic of horizontal wellbore depicting the decreasing contribution as a result of uncontrolled pressure conditions along the horizontal wellbore in a gas cap/water drive reservoir.
Figure 4:
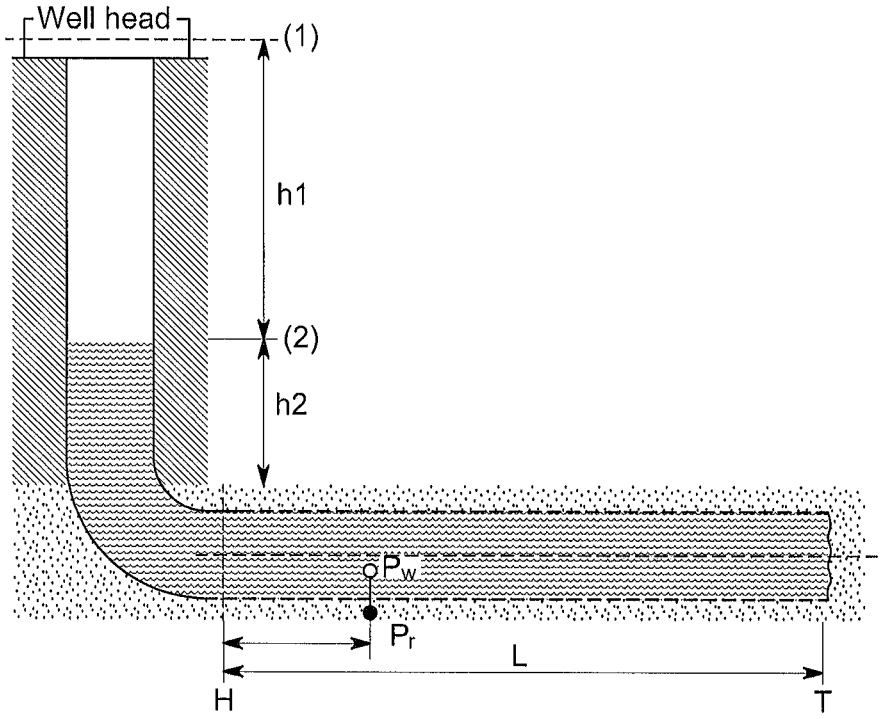
FIG. 4 shows a schematic representation of a wellbore having a vertical section, a transitional section and a horizontal section.

FIG. 4 is a simplified representation of a well having a producing section that comprises three geometric sections: a vertical section, followed by a curved transitional section, and a horizontal section. The true vertical depth of the well is equal to h1+h2. The effective producing length L is measured in the horizontal section from the heel H to the toe T. In this example, the reservoir pressure Pr is insufficient to let the well produce naturally. Assuming in this case the well head is open to atmospheric pressure, the level of the column of liquid h2 is a direct indication of the reservoir pressure with the relationship:

$$Pr=\rho\times g\times h2$$

where ρ=bulk fluid density and g=gravity acceleration

In order to produce the fluids from the reservoir, some form of artificial lifting is needed to overcome the hydrostatic head of the fluid column over depth h1. The minimum applied artificial lift pressure is equal to the static hydraulic pressure over this interval;

$$\Delta Pal>\rho\times g\times h1$$

In practice, to effectively produce the well shown schematically in FIG. 4, the applied artificial lift differential pressure will be higher than this theoretical minimum or alternately the artificial lift position will be closer to the vertical depth of the horizontal leg. The vertical artificial lift system must also overcome any flowing pressure losses or other effects of the wellbore flow.

Figure 5:
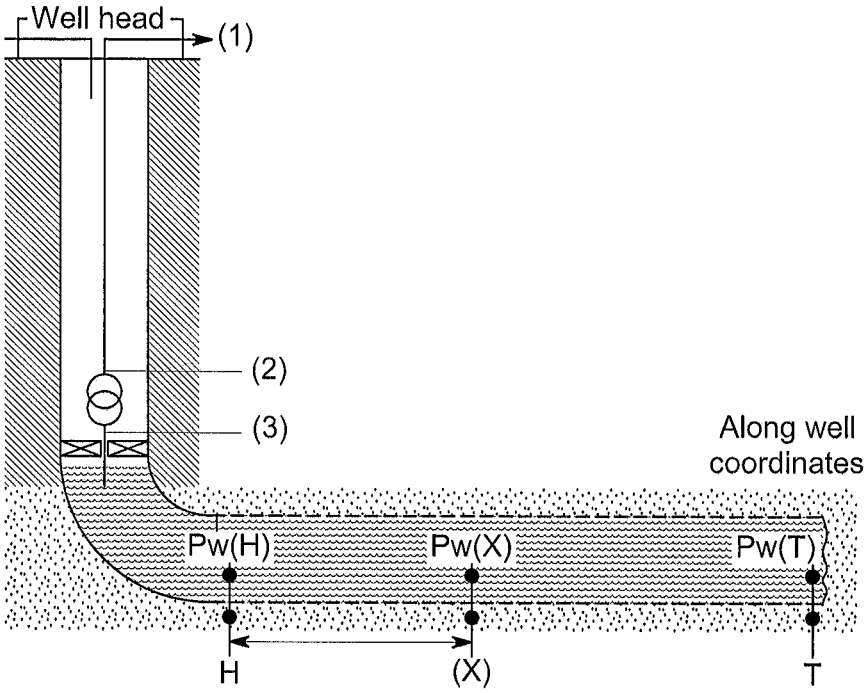
FIG. 5 shows the wellbore of FIG. 4, divided near the bottom of the vertical section, with a vertical lift pump.

FIG. 5 shows a representation of the well shown in FIG. 4, with the addition of a pump placed in the vertical section of the well. The pump could be placed in the transition section, but for technical and operational purposes, it is generally preferable to place the pump just above the transition section. The differential pressure produced by the pump between the inlet (3) and the discharge (2) provides the applied artificial lift pressure up the vertical section. As the pump is in action, a pressure differential is created between Pr (reservoir pressure) and Pw (pressure in the wellbore) below the pump. This pressure differential, referred to herein as drawdown, is the driving force that lets fluid flow from the reservoir into the wellbore.

Figure 6:
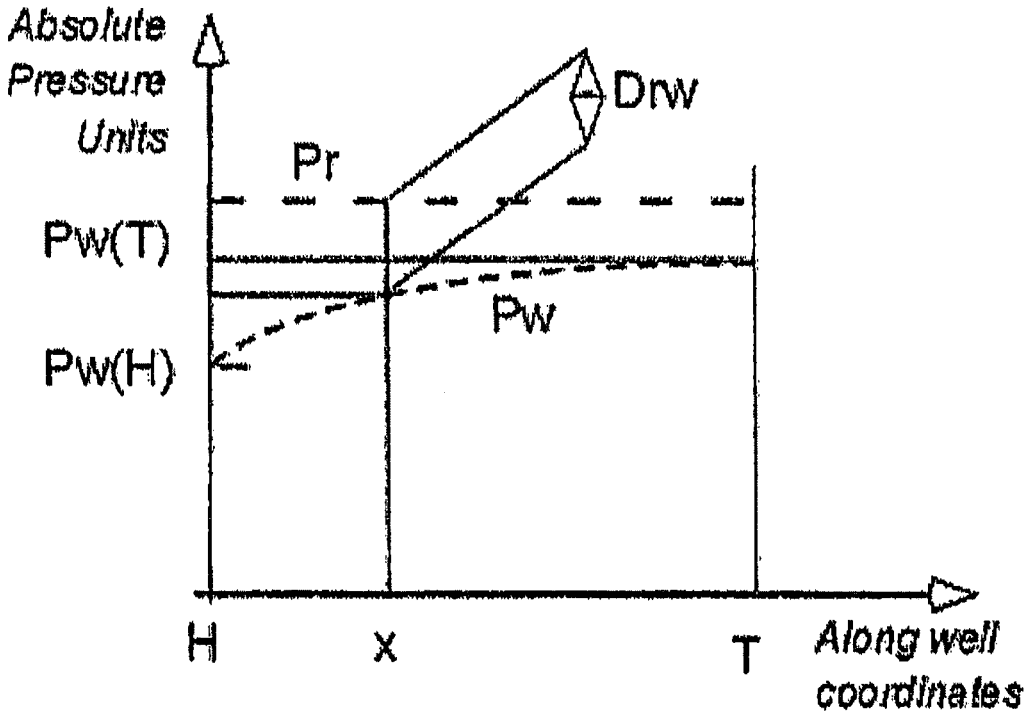
FIG. 6 is a graph showing variance of wellbore annulus pressure Pw along the length of the horizontal.

FIG. 6 is a graph illustrating (not to scale) a simplified model of Pr and Pw as a function of the position along the horizontal wellbore. This model includes many simplifying assumptions including, but not limited to; homogeneity of the reservoir, uniformity of the effect of reservoir geometric boundaries along the well, constancy of the wellbore boundary effect along the well, and single phase behavior of the fluid produced.

The amount of fluid entering the well bore over a unit time and a unit length of wellbore is a function of the drawdown, generally expressed on Inflow Performance Relation (IPR) charts expressing a well specific relationship between drawdown and Flow Rate Q, generally referred to as the Vogel Inflow Model. Assuming zero skin damage at the wellbore boundary, the flow rate q is quasi proportional to the drawdown in the low drawdown region as:

$$\mathrm{PI}(x)=Q(x)/(Pr-Pw(x)),\ \text{or}$$

$$Q(x)=\mathrm{PI}(x)*(Pr-Pw(x))$$

with:

PI(x) Productivity Index at x well coordinates in pseudo steady-state, derived from well testing, and Q(x) Unit flow rate at x well coordinates Pr−Pw(x)=Drw(x) Differential pressure (drawdown) at x well coordinates Fluid flow in the horizontal section suffers from mechanical losses due to friction. A simple relationship for pressure loss due to fluid flow in a pipe is shown below for laminar flow conditions. This equation is used to derive a simplified relationship between horizontal producing length, number of producing intervals, and pressure loss due to friction in the wellbore. Several terms in this equation are assumed constant by considering a single wellbore with multiple producing inlets and complete homogeneity; namely the viscosity, length, and wellbore radius.

Figure 7:
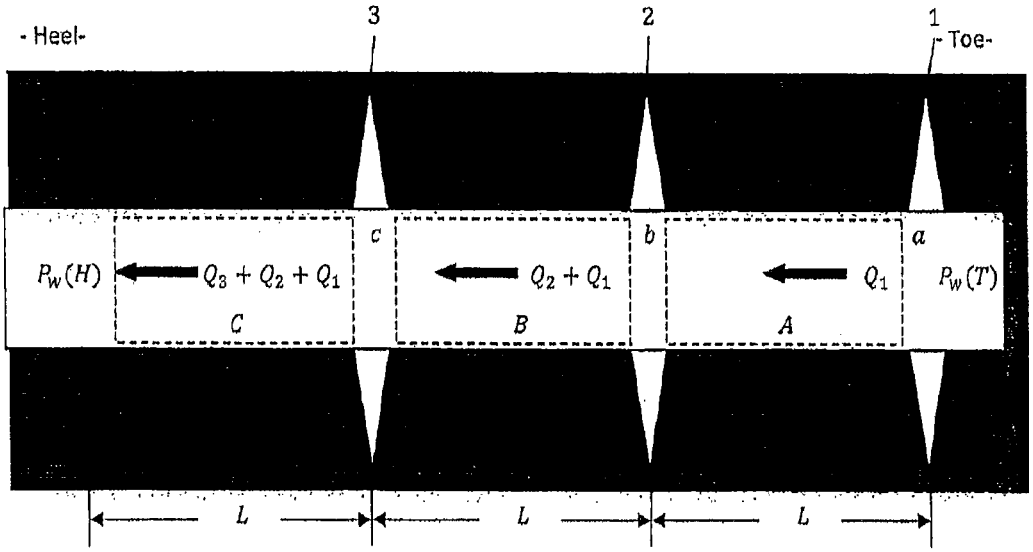
FIG. 7 is a schematic representation of the individual zonal contributions in a horizontal completion which impact the flowing wellbore pressures mechanistically.

With reference to FIG. 7, the equation presented below can be used to approximate the pressure differential across a producing unit length.

$$\delta P=\frac{8\mu LQ}{\pi R^4}$$

Where:

μ=fluid viscosity

R=cased hole radius

Q=flow rate

L=producing unit length

δP=pressure differential across producing unit

Expressing this relationship in terms of the toe and heel pressure differential and the flow outlined in FIG. 7;

$$P_w(T)-P_w(H)=\frac{8\mu L}{\pi R^4}[Q_A+Q_B+Q_C]$$

Where:

$Q_A=Q_1$ $Q_B=Q_1+Q_2$ $Q_C=Q_1+Q_2+Q_3$ $P_w(T)$=Total Pressure at Wellbore Toe $P_w(H)$=Total Pressure at Wellbore Heel The flowing pressure at points a, b, c along the wellbore are proportional to the flow rate of fluids along the wellbore by the following relationships;

$$P_w(a)\propto 3Q_1+2Q_2+Q_3$$

$$P_w(b)\propto 2Q_1+2Q_2+Q_3$$

$$P_w(c)\propto Q_1+Q_2+Q_3$$

Assuming that $Q_1=Q_2=Q_3=Q$, a relationship for each of the discrete intervals (a, b & c) along the horizontal producing wellbore can be obtained:

$$P_w(a)\propto 6Q$$

$$P_w(b)\propto 5Q$$

$$P_w(c)\propto 3Q$$

Figure 8:
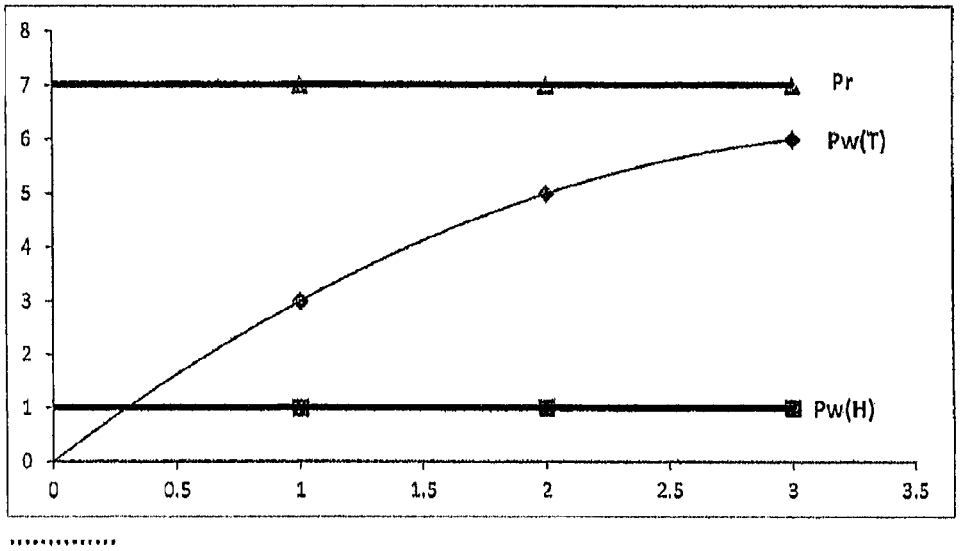
FIG. 8 is a graph showing the pressure gradient in the horizontal from heel to toe due to the frictional losses from flow in the wellbore pipe.

FIG. 8 shows a graphical representation of this simple relationship between wellbore length, flow rate and frictional pressure loss. The graph in FIG. 8, as does that in FIG. 6, shows a narrowing separation from heel to toe. This is due to fluid friction and varying fluid dynamic forces along the producing section. Those skilled in the art may use commercially available software for modeling and estimating the drawdown characteristics as a function of many variables including but not limited to; flow rate, type of fluid, wellbore geometry and permeability at the wellbore/reservoir boundary (also called skin factor).

A non-uniform drawdown causes a non-uniform inflow rate into the wellbore and consequently sub-optimum productivity of certain regions of the well. These adverse pressure effects are additive and increase with distance measured from the heel. This elevated drawdown at the heel could lead to accelerated movement of the gas-oil contact within the reservoir in the heel region leading to an earlier onset of gas interference.

The solution provided by the present invention comprises the implementation of managed drawdown along the length of the horizontal section of the wellbore. In one embodiment, this solution for the horizontal section is combined with a vertical lift solution in the vertical section. The physics of production flow in each of the vertical and horizontal section are different. The vertical section of the wellbore requires relatively higher horsepower because of the need to propel liquids up a vertical distance. The horizontal length and build section of the wellbore presents a fluid transportation problem over horizontal distances, with much lower head requirements and therefore much lower nominal horsepower requirements.

Embodiments of the system and method of the present invention may be applied in conjunction with unconventional or enhanced oil recovery techniques, such as steam-assisted gravity drainage, miscible flood, steam (continuous or cyclic), gas or water injection. Embodiments of the system and method of the present invention may also be used in off-shore situations, including where the well head is located on the sea bed.

In one embodiment, the invention comprises a pump system comprising a production tubing having a vertical section, a horizontal length and a build or transition section. The horizontal length is divided into at least a heel segment and a toe segment. The horizontal length of the production tubing comprises a continuous flow path from toe to heel, which is not open to the reservoir pressure, except in a path through the horizontal pump. A horizontal pump is provided in each of the heel segment and the toe segment, and any intermediate segments. The horizontal pumps have an intake open to the wellbore annulus, and an outlet which flows into the horizontal continuous flow path. The continuous flow path is not open to the reservoir pressure except through the horizontal pumps, meaning that the only fluid entering the horizontal length is through the discharge of the horizontal pumps. As a result, the reservoir does not need to overcome the mechanical pumping and flow losses in the production tubing. Since the reservoir is not required to overcome these losses, the drawdown applied to the reservoir is more uniform along the horizontal length.

In one embodiment, the horizontal length is divided into a plurality of segments, bounded by the heel segment at one end, and the toe segment at its terminus. Each segment comprises a horizontal pump. As a result, pressure control is achieved at multiple locations along the horizontal length. This pressure control comes in the form of quasi-uniform drawdown along the lateral length in the cases of ideally uniform (homogeneous) reservoir conditions. This solution may also manifest itself in a zonal drawdown control suitable to various compartments of the reservoir which are intersected by the wellbore. This distribution may provide a quasi-equilibrium state for efficient production and gas cap drive management within the subject reservoir. In the case of reservoir non-homogeneity, pump placement and/or operation can be used to manage the inflow conditions based upon actual reservoir inflow.

Figure 26:
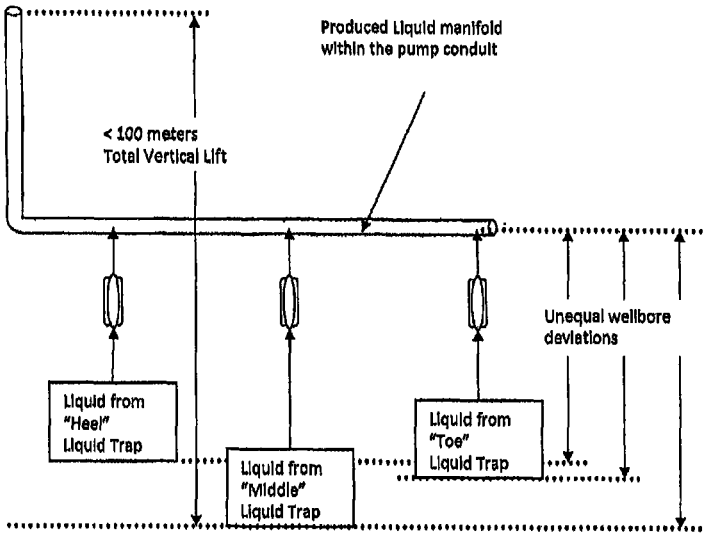
FIG. 26 shows a schematic representation of multiple diaphragm pumps configured in a parallel operating mode.

In essence, the plurality of horizontal pumps acts in parallel, each pumping into the continuous horizontal length of the production tubing, as shown schematically in FIG. 26. This allows the pump system to be configured to selectively remove liquids from any point along the horizontal segment of the wellbore in which they may accumulate, and for the liquids to be produced fully to surface. The parallel pump configuration also multiplies the total produced wellbore fluid flow rate achievable by an array of any number of pumps. In a parallel configuration, the total overall produced wellbore fluids flow rate that can be pumped is equal to the sum of the maximum produced liquid throughput rates achievable by each pumping units individually. The total liquid throughput rate of an array of pumps in a parallel configuration is equal to the number of pumps multiplied by the liquid volume throughput capacity of a single pump.

Figure 27:
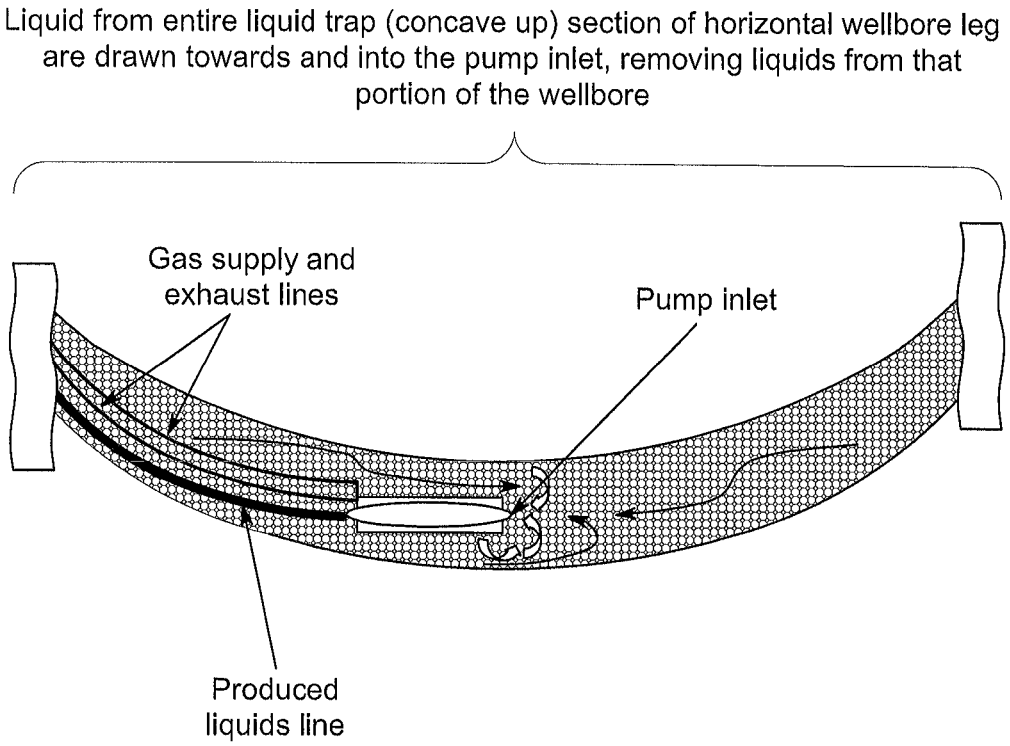
FIG. 27 shows a schematic representation of a single diaphragm pump installed in a liquid trap.
Figure 28:
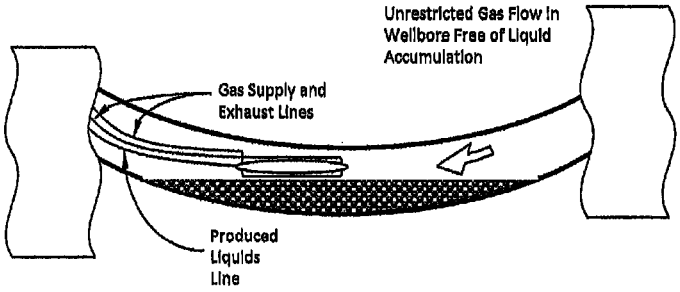
FIG. 28 shows a schematic representation of FIG. 27, with liquid removed from the liquid trap.

In one embodiment, particularly in a gas well, the array of horizontal pumps may be placed and used to remove liquid from any liquid traps present in the lateral (horizontal) section of the wellbore, delivering these liquids to a vertical lift pump. A schematic of this liquid removal from the various liquid traps in the wellbore geometry is shown in FIGS. 27 and 28.

The vertical deviations of the various liquid traps will be typically unequal; the liquid traps will represent local minima (dips) within the wellbore geometry in which produced liquids will accumulate. The geometry of the wellbore will be known before the completions process. The pump inlets should be spaced through the wellbore to draw in liquid from the bottom-most point within each of the liquid traps in order to maximize the liquid produced from the well and minimize the flow restriction of the reduced cross-sectional areas on the gas flow.

Figure 9:
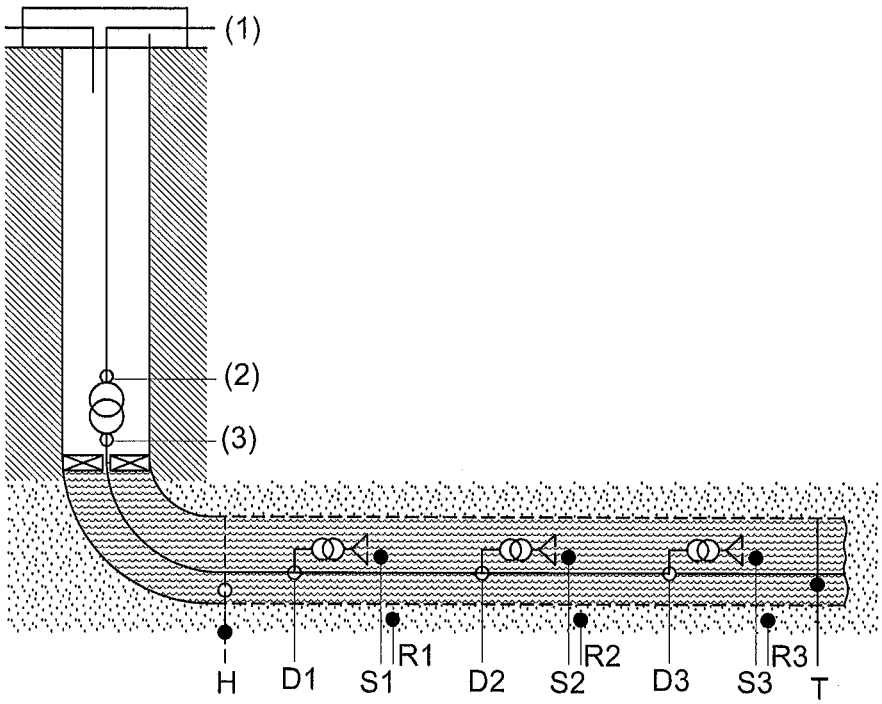
FIG. 9 shows the wellbore of FIG. 5 with a number of horizontal pumps in the horizontal section and a vertical lift device placed the bottom of the vertical section.
Figure 10:
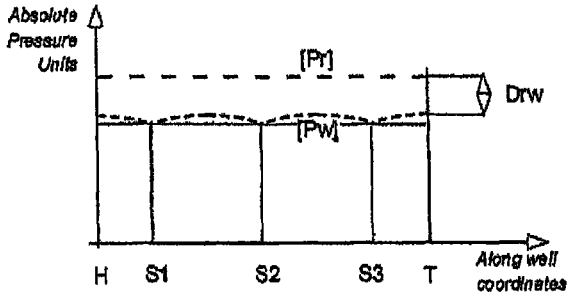
FIG. 10 is a graph showing pressure variations in the wellbore annulus along the horizontal length of FIG. 9.

FIG. 9 shows the addition of a plurality of horizontal pumps placed in the horizontal section of the well. The pumps may be approximately equally spaced apart to optimize reservoir inflow. The pump spacing may not be substantially equal but instead spaced as wellbore geometry and reservoir and fluid properties dictate. Each pump collects fluids in a substantially equal proportion in the horizontal wellbore on the suction side and discharges it at higher pressure into the production tubing. FIG. 9 also shows a vertical lift pump placed in the vertical section of the well. The main purpose of this pump is to provide the fluid lifting power from near the transition section up to the surface. FIG. 10 shows that Pr is constant (uniform reservoir assumption) and that Pw is nearly constant along the length of the horizontal due to the distributed drawdown applied by the plurality of horizontal pumps.

Figure 11:
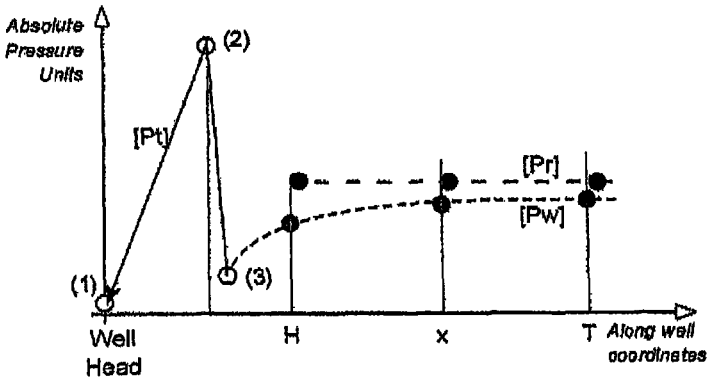
FIG. 11 is a graph showing pressure variations in the wellbore and the production tubing shown in FIG. 5.

The graph of FIG. 11 shows pressure variation associated with a prior art producing scheme, having a single vertical lift pump creating drawdown in the heel segment. The lowest pressure is at the vertical lift pump suction level (3). The flowing wellbore pressure increases towards the toe due to friction in the wellbore casing.

Figure 12:
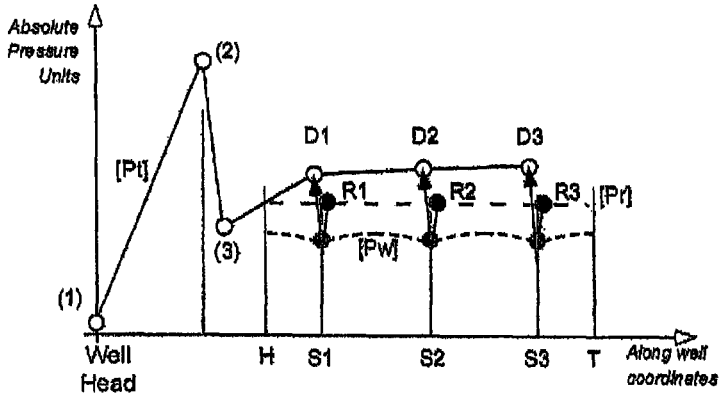
FIG. 12 is a graph showing pressure variations in the wellbore and the production tubing shown in FIG. 9.

The graph of FIG. 12 illustrates the pressure scheme in the situation of a three pump arrangement spaced in the horizontal production tubing. It may be seen that Pw at each of S1, S2 and S3 is approximately the same. This graph illustrates the thesis that pumps placed in the horizontal section "at the sand-face" can improve the reservoir drainage conditions.

As shown schematically in FIG. 12, horizontal pumps at S1, S2, and S3 contribute substantially equally in fluid collection and discharge at a relatively small pressure which varies slightly to account for fluid friction in the production tubing. The vertical lift pump placed further downstream (here at bottom of the vertical section) provides with the bulk of lifting pressure and power.

The discharge pressure provided by the horizontal pumps placed in the horizontal can be optimized in concert with the intake pressure both by design and by controlling each of the pumps during operation.

Figure 13:
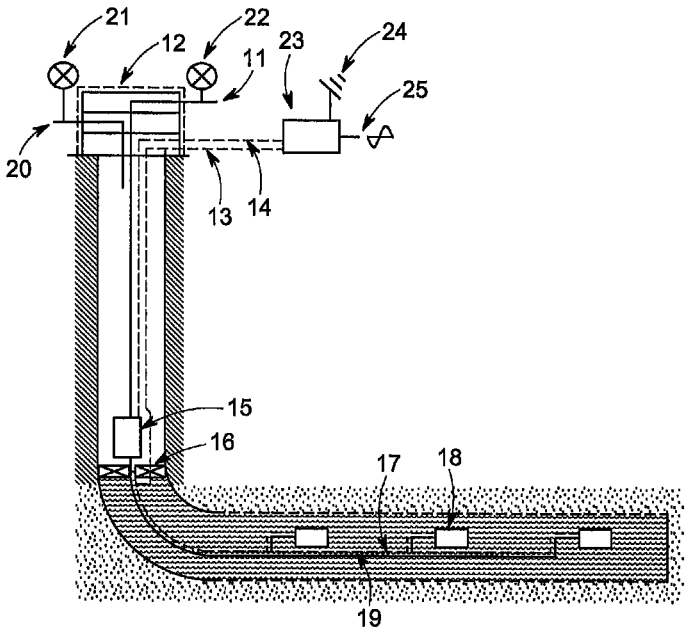
FIG. 13 is a schematic representation of one embodiment of the system of the present invention.

As shown in FIG. 13, a production system includes a vertical lift pump (15), an isolation device (16) and horizontal pumps (18). Production tubing (19) collects the fluids that are produced in the horizontal well section and connects to the intake side of the vertical lift pump (15). The vertical lift system may comprise any suitable technology having sufficient lift capacity to lift liquids through to surface. In conjunction with a pressure isolated vertical lift solution the horizontal pumps (18) have a low horsepower requirement, and may comprise any suitable lifting device.

In one embodiment, the horizontal pumps may comprise any suitable lifting device well known or otherwise including but not limited to: diaphragm pumps, electric submersible pumps, hydraulic submersible pumps, jets pumps, pneumatic drive pumps, gas lift, gear pump, progressive cavity pump, or a vane pump, or any combination thereof. In one preferred embodiment, the horizontal pumps comprise a diaphragm pump as described herein.

Power and control is supplied to the array of horizontal pumps (18) via line (17) connected at surface to the power and control unit (23). The power and control line may comprise power, monitoring, injection and control lines. Controls support downlink commands to pumps, pump status feed-back, and measurements taking place in the pump assembly. Other measurements and controls may also take place along the pump array at specific location or spread over a section or the whole length of the horizontal production section using technology such as fiber optic arrays.

If electric power is used, the vertical lift pump (15) and the array of horizontal pumps (18) can share common lines for power, down-hole monitoring, data and control commands.

The vertical lift pump (15) is composed of a pump and may include a gas separator placed upstream of the pump intake. Separating liquid and gas is generally performed to better control the flow regime and improve the lifting efficiency. The gaseous phase can then be released by the separator into the annulus (not shown) and collected at the well head assembly (12) via the gas exhaust line. Placing a gas separator on the upstream side of the pump is preferable because pressure in the production tubing is lower as illustrated by the point (3) of the graph shown in FIG. 10. Probes (not shown) can be embedded in the assembly. A pressure gauge probe sensing the intake fluid pressure is preferred. A differential pressure probe and a temperature measurement probe are also preferred with the use of a gas separator.

The vertical section and the horizontal section of the wellbore are physically isolated with an isolation device assembly (16). In one embodiment, the isolation device may include a plug receptacle or a valve or any other isolation device that allows temporary isolation of the lower well section from the upper section in certain instances such as initial well completion or work-over in the upper well section. The isolation device (16) may also include a junction receptacle that allows separating the upper from the lower production strings at the time of the initial well completion or when the pump assembly (15) must be replaced or whenever major well intervention requires a removal of part of or the whole production string. The isolation device (16) may also include isolated passage ways for power, control, injection and measurement lines (17). In one embodiment, the assembly includes all mating features that allow connecting the pathway of the production tubing, connecting and isolating from each-other and from the well environment, all components of power supply, pump controls, injection and down hole measurements, all together represented schematically in FIG. 13 by lines (17).

A control unit (23) is located at surface in the vicinity of the well head (12). The main power (not shown) is provided either from a utility grid or generated locally by commonly available means, such as a generator, motor-gas compressor, or motor-hydraulic pump. The control unit (23) can supply conditioned power to the vertical lift pump (15) and to the array of horizontal pumps (18) via lines (17), if such pumps require electricity. Probes (not shown) measure the flow regime in the gas flow lines (20) and liquid flow line (11) at the well head. Preferably, these probes are connected or have their output shared with the control unit (23), physically or wirelessly.

The control unit (23) may transform (if need be), condition, control and supply power to all elements constitutive of the downhole production system. As well, the control unit receives all relevant monitoring data coming from downhole probes. This data may also be recorded, processed, saved and broadcast via a communications network. As well, the control unit (23) considers the assigned performance level and the monitoring data and assigns specifically to the vertical lift pump (15) and each of the horizontal pumps (18), a regime level that optimally runs the production system by sending commands and or adjusting power supplies accordingly. The control unit (23) may comprise a suitable computer processor running software to implement the desired control regime.

Figure 14:
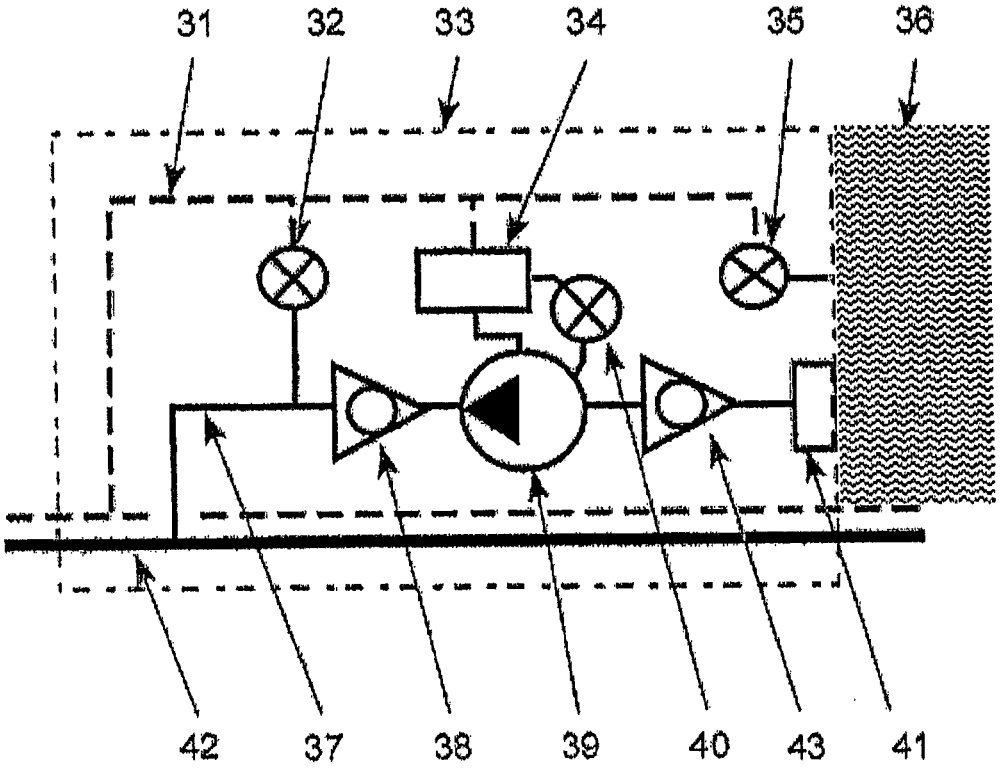
FIG. 14 is a functional representation of one embodiment of a horizontal pump assembly of the present invention.

A broadcast function (not shown) is optional but is preferred in order to help operators to understand the well behavior and performance, and via human or computer action take any necessary steps such as alerts, send commands to down hole pump controllers (34) shown on FIG. 14 to change pump regime, or modify the regime of the main vertical lift assembly (15). Such components of the production system can be shared in a variety of fashions among a plurality of wells. It can be also located partly or in whole on the sea-bed in case the well head is located sub-sea.

FIG. 14 is a functional diagram of one embodiment of a horizontal pump assembly that connects hydraulically to the wellbore space (36) on one side and to the production tubing (42) via the passage way (37). The main constituent is the pump (39) that is connected to a fluid intake unit (41) that may include a filter. The filter protects from unwanted solid particles entering the pump and potentially causing damage. On the discharge side, a check valve (38) prevents any fluid flowing from inside the production tubing back into the pump. As may be required by the specific pump technology employed, a check valve (43) may be included on the intake side of the pump to prevent fluid from flowing back into the wellbore space from the pump.

In one embodiment, a probe (35) senses the actual wellbore fluids conditions in the vicinity of the pump intake, such as pressure and temperature near the production tubing downstream of the discharge check valve (38). Preferably, absolute pressure measurement is desired on the intake side for probe (35), whereas a differential pressure and temperature measurement in the outlet side (32) is sufficient. The pressure differential can be taken at the pump suction and downstream of the check valve. Flow rate measurement may also provide useful information. It can be implemented either between the valve (38) and the hydraulic connection with the production tubing or, alternatively, be directly in-line with the production tubing downstream of the pump assembly. Flow rate measurement is important as in-situ data can inform on how far or close the drainage array performs from the optimal conditions. In the case where a production fluid mixture behaves substantially as a single phase and the well inflow is rather uniform, a differential pressure measurement can be simple and low cost, and still help control the array performance satisfactorily. However, more complex inflow characteristics or unstable flow regime may require more direct measurements to derive the individual flow rate contribution of each pump assembly.

A pump controller (34) receives commands from surface and help set a proper pump regime within each individual pump assembly. The pump controller may comprise a logic device operatively connected to the surface control system, and may function which activates the pump or modifies the pump operation. Depending on the pump technology, appropriate pump regime feedback can be used for closed loop or open loop control. Further in-situ monitoring can help assess the efficiency of the machine and possibly preempt some dramatic failure by reducing the regime or even disabling any individual pump, without having to halt the whole array. A probe (40) can either measure the revolutions of a rotary pump or the strokes of a cyclical pump or any direct characteristics of the regime in addition with other measurements such as electric current, mechanical vibrations, hydraulic pressure pulsation or any sensing that can contribute to making real-time diagnostic of the machine at work.

Figure 15:
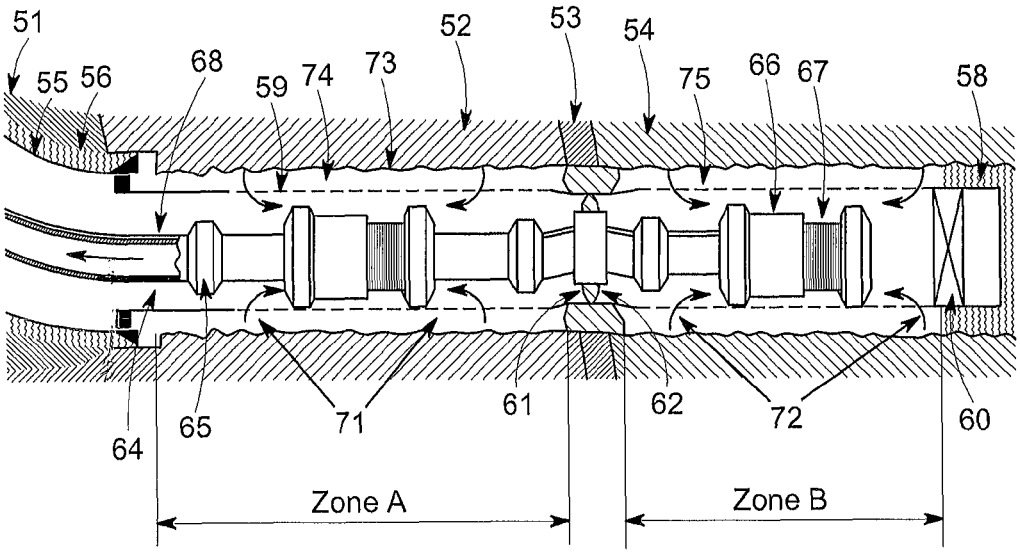
FIG. 15 is a detailed view of the horizontal length of one embodiment of the present invention.

In one example of a horizontal completion, FIG. 15 illustrates the configuration of a producing wellbore (57) that intersects two distinct bodies of hydrocarbon bearing formations respectively (52) and (54) that are separated by a relatively non-permeable layer (53). In one embodiment, the horizontal completion comprises a perforated liner, however, the completion may also use open hole gravel pack and screens or any other reservoir suitable completion or even barefoot. The fluids produced in each of zone A and B are collected by the respective horizontal pumps at different flow rates and wellbore pressures that will optimally match the distinct properties of each reservoir zone, both in term of rock properties and fluid properties.

A casing shoe is set just at the top of layer (52) at the bottom of the formation layer (51). A cement sheath (55) seals the casing and prevents hydrocarbon fluids from migrating in the casing annulus. A producing liner (59) is set at bottom of the casing, the liner is composed of several pre-perforated liner sections and includes a plain section that supports an external open hole isolation device that is set at the crossing of layer (53) to establish a hydraulic barrier in the annulus formed by the open hole (57) and the production liner (59). A cement plug (58) seals-off the bottom end of the well annulus, while an isolation device (60) seals-off the inside of the production liner.

A production tubing string (64) may comprise jointed steel pipe, or coiled tubing, having some solid stabilizers (65) that protect and secure some cabling (68) onto the outside of the tubing. The production string supports two horizontal pumping assemblies (66) each including an intake filter. Each pumping unit is respectively draining fluids produced in the two zones respectively A and B, isolated by the seal (62) set in a seal-bore section located inside or in the vicinity of the external isolation device. The depiction of two zones A and B is exemplary only, and in practice, a plurality of zones and consequently a plurality of horizontal pumps may be implemented. Adjacent zones need not be separated by a non-permeable layer.

Fluids coming from each reservoir compartments (52, 54) migrate into the respective near well-bore sections, then in the respective open-hole annuli (74, 75) and towards the intake filter of each respective horizontal pump assembly. The flow commingles in the production tubing and circulates towards the upper well section.

Each horizontal pump assembly may be operating at a rate that can be varied as a function of dynamic parameters measured while producing. As a by-product of this method, specific inflow properties of each compartment can be derived for various flow rates without the need for logging intervention with wireline probes. The resulting in-situ data can benefit the reservoir description and consequently help optimize well placement and completion design for the wells to be made as an oilfield continues to develop.

In another embodiment two pumps (or more) may share a common inlet (suction with or without filter) and thereby inherently increase the reservoir inflow in one region of the wellbore wherein the flow is greater than the maximum output allowed by one individual horizontal pump.

Figure 16:
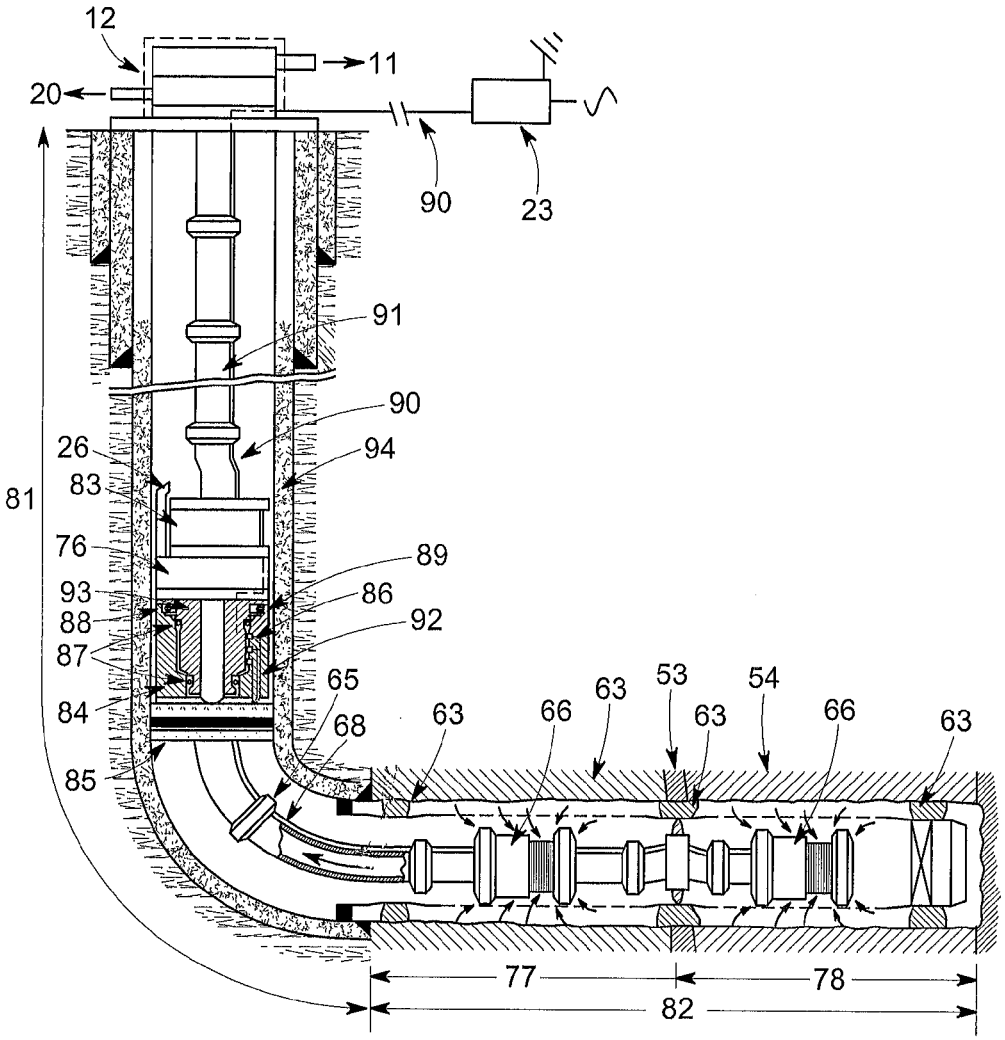
FIG. 16 is a schematic representation of one embodiment of the present invention.

In the case the reservoir pressure is relatively low, or insufficient to naturally propel the fluid flow up to the surface, a vertical lift pump system may be used. FIG. 16 is a simplified representation of a well completion that applies the method of combining managed horizontal flow and a vertical lift system. The well is basically composed of the upper section (81) with its upper completion and the lower section (82) that includes here two production zones (77, 78) which respectively drain the reservoir compartments (52, 54) separated by a low or non-25 permeable layer (53). This two-zone completion is similar to the one detailed on FIG. 15. Depending on the length and geometry of the horizontal length, there is no practical limit to the possible number of producing zones and consequently pump and isolation assemblies. In one embodiment, annular hydraulic isolation devices physically limit the length of wellbore that is drained in each respective zone. The production tubing (64) collects the fluid produced in each zone and pumped by two pumping assemblies (66). The fluid commingles in the tubing and is pushed towards the vertical lift pump system. A cable (68) represents a group of wires and power lines and I or activation I injection lines preferably bundled and secured against the outer wall of the tubing with cable clamps (65).

In one embodiment, the upper end of the lower production string connects to a production isolation device which firstly isolates the upper section of the production casing (94) from the production zones and secondly secures mechanically the lower string in position. The upper side of the isolation device includes a junction receptacle (93) that includes a plurality of mechanical, hydraulic, pneumatic and electrical features. A multi-line, multi-function collector (86) is embedded into the junction receptacle (84). Seals (87) keep the production fluids flowing in the main production conduit formed into the junction in continuity with the lower string. The upper mating part (93) of the junction is attached to the artificial stack composed of a gas separator (76) and a pump (83). It includes the mating components of the multi-function collector (86) with its associated cabling and the hydraulic conduit that channels the production fluids. An orienting key (88) and a mechanical latching device (89) help orient, position and secure the stack atop the isolation device and junction receptacle assembly. The upper side of the pump features a tubing fitting which connects to the upper section of the production tubing (91) all the way up to the well head via the well head outlet (11). The cable (90) supplies power and supports control and measurement signals to the lower production string and the upper artificial lift assembly. It is secured on the tubing (91) via cable clamps (65). The cable runs through the well head assembly via dedicated pressure feed-through connectors and functionally connects to the surface unit controller (23).

The separator (76, 83) releases the gaseous phase produced in the separator in the production casing annulus via the gas discharge port (26). This gas is collected at the well head outlet (20).

In one embodiment, the production string is preferably installed in the well in at least two distinct phases. Firstly, the lower production string including the production isolation device and junction receptacle is lowered in the well and the isolation device is set once on depth. Secondly, the upper production string composed of the vertical lift pump stack with the male junction at its lower end is lowered in the well. The junction orienting key helps self-orient the upper junction into the receptacle. The latch is effected by setting weight on the junction. Then, the hydraulic integrity of the production string may be verified by applying pressure against a temporary isolating element such as rupture disk or any suitable disappearing plug technology. The electrical connections are completed at the tubing hanger level and the well-head stack can be installed.

The separation of the wellbore as described herein creates two separate and individually controllable chambers within the wellbore completion, as may be seen in FIG. 17. The vertical chamber with fluid level (h3) may be controlled by individually changing the pumping rate of the vertical lift solution. These rate changes are determined using a controller. The pressure transducer (PTv) provides a signal conveying the pressure due to the fluid height in the annulus. In order to maintain a relatively constant fluid level, and therefore relatively constant net positive suction head (NPSH), the rate is adjusted based on the live pressure information from PTv.

Conventionally, with a single drawdown pump landed in the vertical and attempting to drawdown the reservoir; the backpressure restricting the well productivity is equivalent to:

$$PT_h=\rho g h_2+\rho g h_g+P_{a1}+P_{D1}$$

Where $P_{D1}$ is a dynamic loss term which is a function of viscosity, wellbore radius, wellbore length and flow-rate. $P_{a1}$ is the static annular pressure in the upper wellbore segment.

Reservoir fluids from the wellbore are pumped into the horizontal length of the production tubing, as detailed below, and thereby isolating the production from the reservoir via the horizontal pumping completion. The head pressure of the gas in the annulus is negligible. Therefore, the horizontal backpressure against the formation becomes:

$$PT_h=\rho g h_1+P_{a2}+P_{D2}$$

where $P_{D2}$ is a dynamic loss term which is a function of viscosity, wellbore radius, wellbore length and flow-rate. $P_{a2}$ is the annular static pressure in the lower wellbore segment. Due to the distributed inflow allowed by the pumping methods described herein, the back pressure term in this formation back pressure relationship will be greatly reduced. The back pressure is reduced because of the improved flow pattern within the wellbore on the suction side of the vertical pumping system.

This comes with a significant advantage in the sense that the height value h1 is fully controllable based on the minimum NPSH requirements for the horizontal pumps and by adjusting the volumetric displacement rate of the horizontal pumps into the separation annulus above the isolation device. By virtue of completing the wellbore in this "divided and isolated chamber" configuration the h1 distance can be minimized since the only variable influencing its height is the required NPSH of the horizontal pump system.

$$\mathrm{NPSH}=P_{a2}+\rho g h_1$$

The variable which links the horizontal and vertical pumping system chambers is h3; the liquid height h3 can be used to effectively and simultaneously control the production rates of the vertical and horizontal systems. This is shown by the following relationships:

$$\delta h_3=f(Qv,Qh)$$

Where:

$Q_v$=Flowrate from vertical A/L solution $Q_h$=Flowrate from horizontal A/L solution Now, in the vertical chamber of the wellbore the pressure value at the PTv location is as follows:

$$\mathrm{PT}_v=P_a+\rho g h_3+\rho g h_g$$

Considering a pumping well and single tank battery, Pa remains constant; and since generally the gas head is negligible, the equation reduces to:

$$\mathrm{PT}_v=\rho g h_3$$

Assuming incompressible liquids yields:

$$\mathrm{PT}_v \propto h_3$$

and by extension $$\delta \mathrm{PT}_v \propto (\delta Q_v, \delta Q_h)$$

Therefore, assuming incompressible media in the wellbore, the steady state value for h3 is arrived at by maintaining equal flow rates from the vertical and horizontal artificial lift systems. Inherently, a decrease in head pressure due to h3 in the annulus may indicate an increasing gas volume ratio in the fluid being pumped from the horizontal. Any variation in the pumping requirements of the vertical or horizontal systems (Qv or Qh) to maintain h3 can be used by the control scheme to determine either permanent or transient changes in the flowing bottom hole conditions. These changes can include but are not limited to: changing gas oil ratios, fluid compositions, pump failure, reduced pumping efficiency, or changes in reservoir pressure. System optimization can also be achieved by varying pump conditions in response to these parameters.

In one embodiment, because the horizontal pumps act in parallel, a number of horizontal pumps may be redundant pumps in that they may not be used unless necessitated by a pump failure, or as part of a regular pump rotation. For example, two horizontal pumps may be disposed in any given horizontal segment, but where only one is in operation at any given time. The other pump may have a backup role, and the two pumps may be used in rotation as required. This strategy may provide continuous operation even in the event of a pump failure. In one embodiment, the two pumps may be located in the same isolated segment and may be disposed relatively close to each other, or have in common one suction inlet facing the reservoir. The pumps may be operated in tandem to increase the output from the segment to some value larger than the volumetric output of one individual pump.

Figure 18:
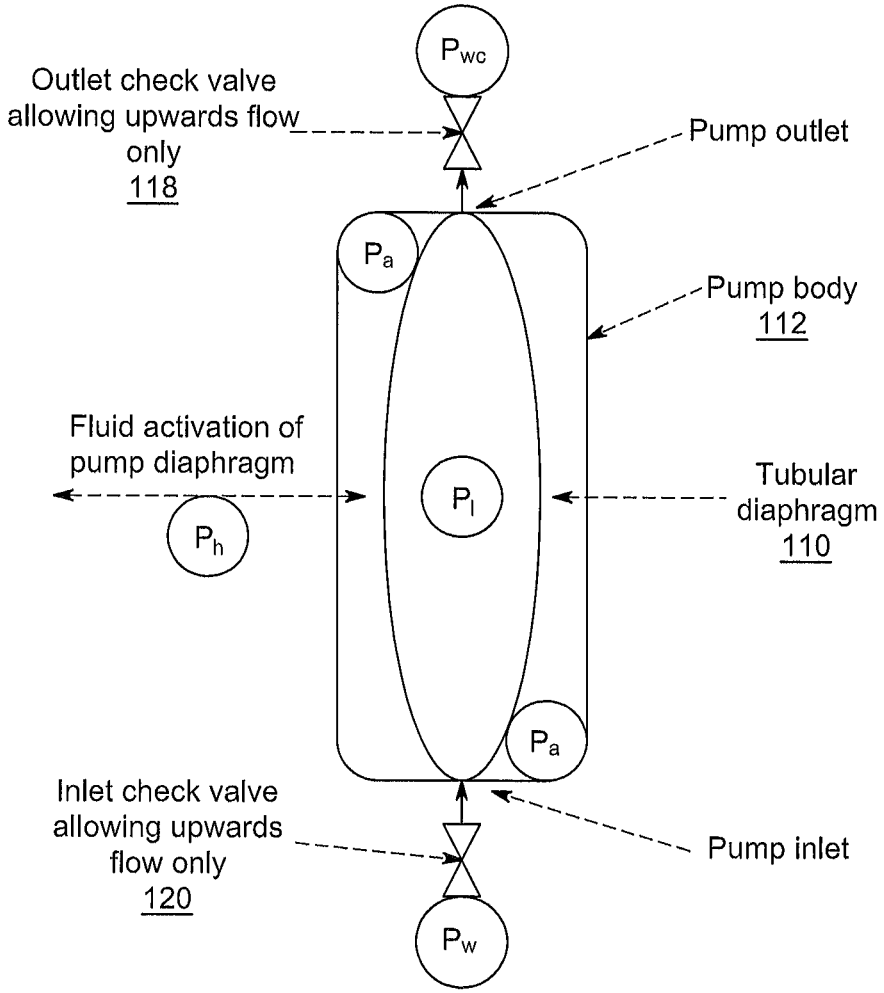
FIG. 18 shows a schematic representation of a diaphragm pump.
Figure 19:
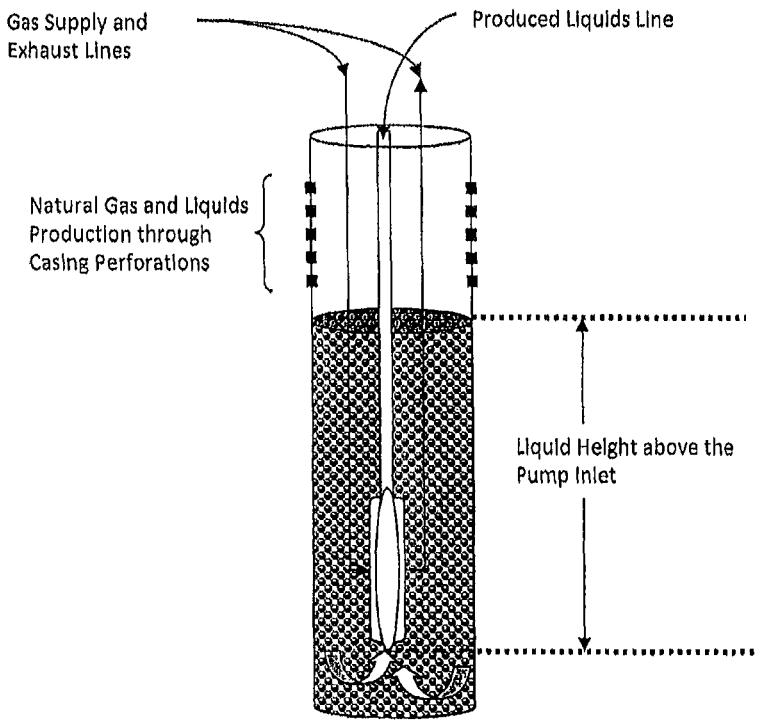
FIG. 19 shows a schematic representation of a diaphragm pump installed in a vertical wellbore, immersed in liquids.
Figure 20A:
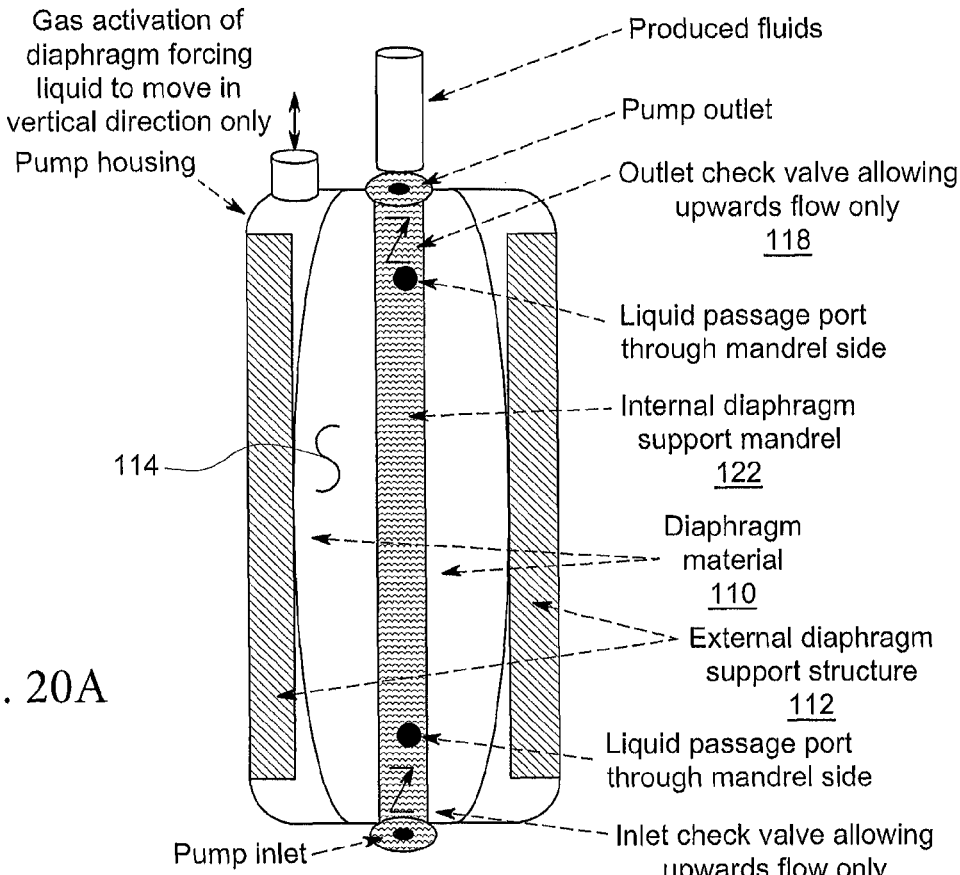
FIG. 20A shows a schematic representation of a diaphragm pump in longitudinal cross-section.
Figure 20B:
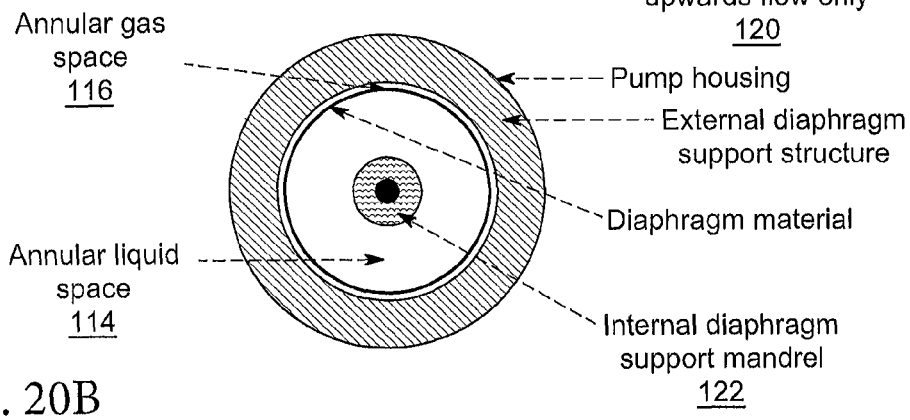
FIG. 20B shows a transverse cross-section.

In another aspect, the present invention comprises a diaphragm pump (100) and system, suitable for use as a horizontal pump in the systems and methods described herein, or possibly as a vertical lift pump. A diaphragm pump is a positive displacement device that relies on the activation of a flexible diaphragm (110) to motivate fluid axially through the length of the pump, as is shown schematically in FIG. 18. In one embodiment (shown in FIGS. 20A & 20B), the pump mechanism uses a tubular diaphragm (110) oriented axially within a rigid outer housing (112) to create an inner production chamber (114) and an outer activation chamber (116) within the pump.

In one embodiment, one-way valve assemblies (118) are situated at the pump inlet and outlets in order to direct the flow in one axial direction through the pump. The pump is activated by supplying an activation fluid to the activation chamber (116) on the outside of the tubular diaphragm, causing the collapse of the flexible diaphragm and displacing any liquid within the inner production chamber (114) out the outlet end of the pump unit.

The activation fluid is supplied from a surface source, and may be selectively distributed to an array of pumps down hole in any configuration including pumps arrayed in serial or parallel configurations, by the employment of a directional control valve (not shown), which may preferably be associated with a pump downhole. This activation fluid directional control valve is operated via surface inputs to a downhole pump controller, to selectively apply and remove fluid pressure to the outside of the tubular diaphragm (110) of any chosen pump or pumps. The exhaust activation fluid may be controlled by the same control valve, or a separate control valve. The activation fluid directional control valve may be operated by any common valve operation method including but not limited to: mechanical activation, pressurized gas activation, pressurized liquid operation, electrical operation or pneumatic operation. Accordingly, the control system may control activation and pump rate of any individual pump by controlling the supply of activation fluid from the surface.

Figure 21A:
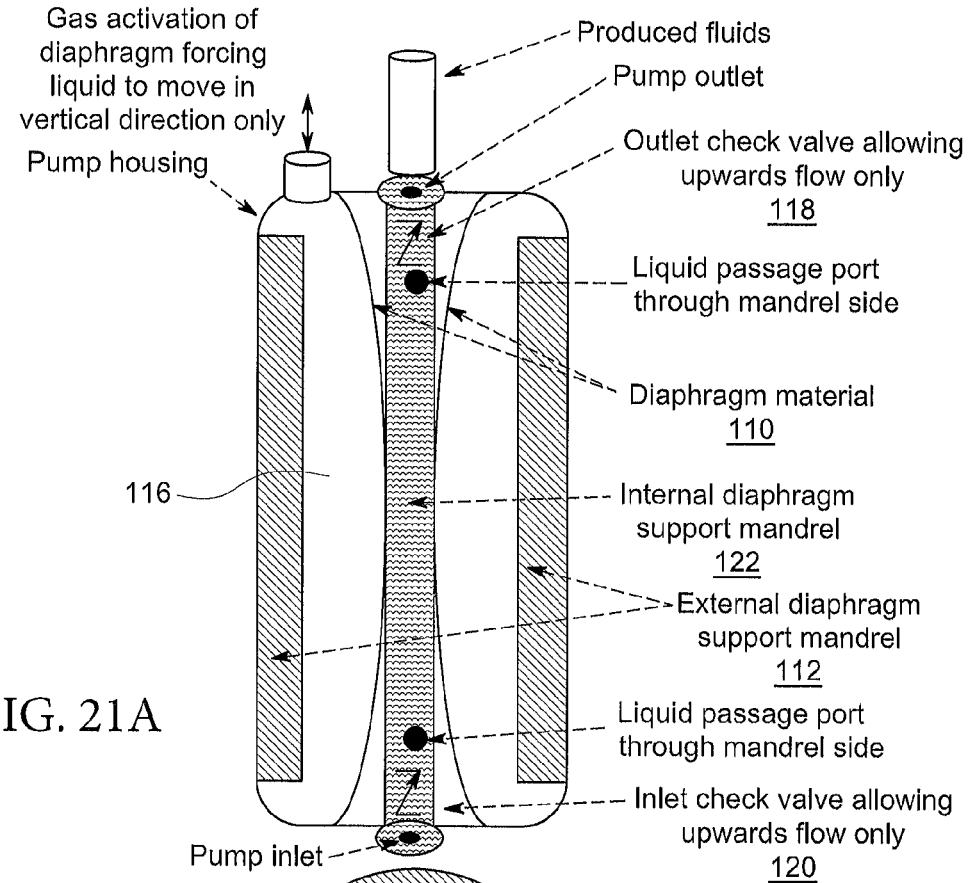
FIGS. 21A and 21B shows views of the embodiment of FIGS. 20A and 20B with a pressurized diaphragm.
Figure 21B:
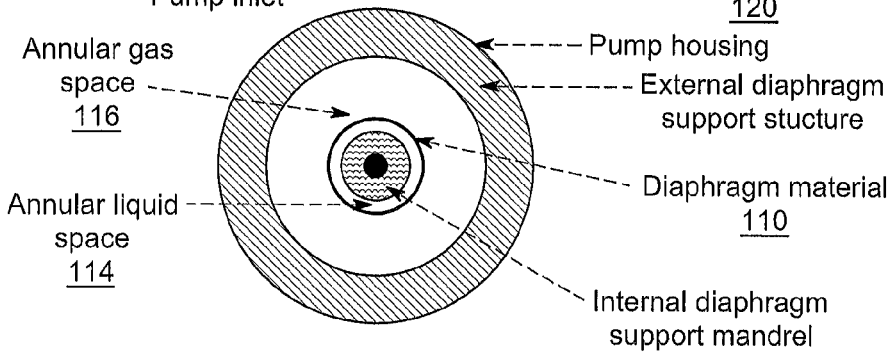

To draw fluid into the internal pump chamber, the pressure in the pump activation fluid (Pa) is lowered below the ambient pressure (Pw) in the wellbore. This causes an evacuation of the volume of activation fluid in the annular chamber (116) around the diaphragm (110) causing the diaphragm to bellow outward, thereby drawing fluid drawn into the pump chamber (114) through lower check valve assembly (120), shown schematically in FIGS. 20A and B. The activation fluid is then pressurized, squeezing the diaphragm and expelling the contents of the pump chamber (114) out through the outlet check valve assembly (118), shown schematically in FIGS. 21A and B. By alternately cycling the activation chamber and diaphragm between the 'inflated' and 'deflated' states, the wellbore fluids are pumped axially as required.

In one embodiment, the use of a diaphragm material with no rebound capability (i.e. non-elastic) reduces the stress on the material during the stroke of the pump. In one embodiment, the diaphragm comprises a reinforced fabric.

Repeated cycling of the diaphragm places a high demand on the diaphragm material. Thus, in one embodiment, the pump assembly comprises diaphragm support structures that fully support the diaphragm in both the inflated and deflated states. These support structures restrict the pressure load borne by the diaphragm material in both the inflated and deflated states. In one embodiment, an internal support structure comprises an internal mandrel support (122) which provides a support for the diaphragm in the collapsed state at the end of the pumping segment of the cycle. This support structure prevents the diaphragm from failing due to folding or pinching as a result of uncontrolled collapse of the flexible membrane.

In one embodiment, the diaphragm pump (100) comprises a flow-through passage (101) which allows fluid to flow through the pump unimpeded. The pump comprises a top flow sub (102) and a bottom flow sub (103) which define the flow through passage (101), as well as a discharge passage (104) and an intake passage (105) which are in fluid communication with the production chamber (114) of the pump.

The top flow sub (102) and the bottom flow sub (103) are connected to the cylindrical pump housing (112). The flow through passage (101) continues through the hollow internal mandrel (122) at both ends.

Figure 22A:
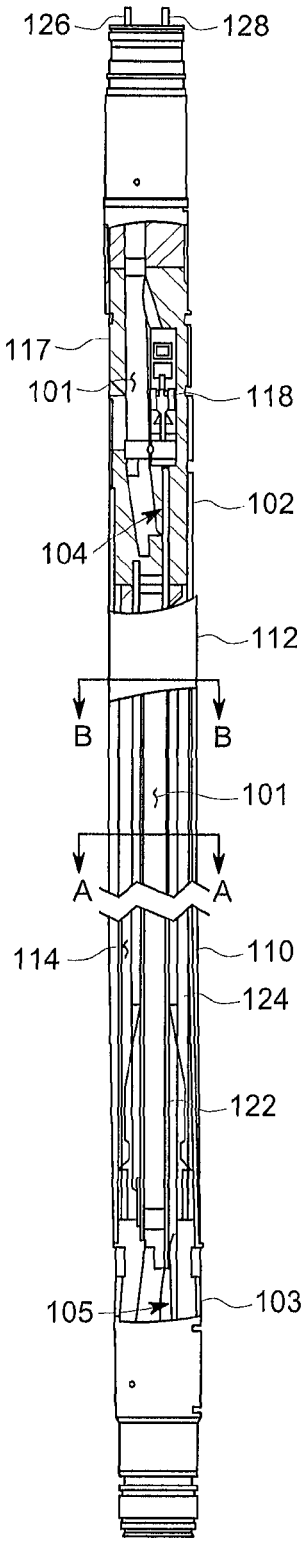
FIG. 22A shows one embodiment of a diaphragm pump in axial cross-section.
Figure 22B:
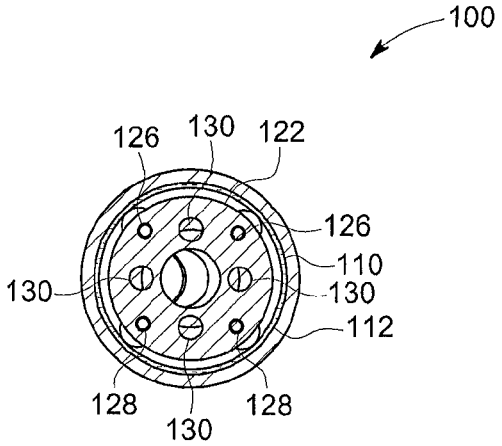
FIGS. 22B and 22C shows views of transverse cross-sections along lines B-Band A-A respectively in FIG. 22A.
Figure 22C:
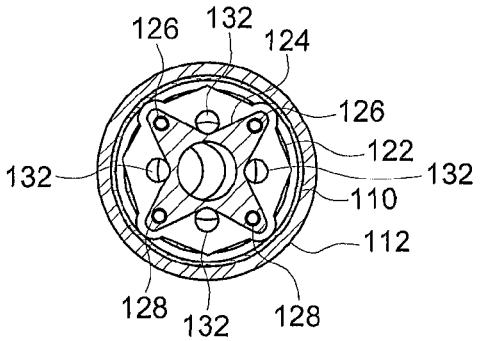

In one embodiment, the internal mandrel (122) has a lobed transverse profile through a middle section, which transitions to a polygonal transverse profile and finally to a circular profile at both ends of the mandrel (122), as may be seen in cross-sectional FIGS. 22B and 22C. As a result, the production chamber (114) primarily comprises of the space between the lobes (124), of which there are four lobes in the embodiment shown. The diaphragm (110) is sealed to the ends of the mandrel (122). Activation fluid inlet passages (126) and exhaust passages (128) run axially through the lobes (124), and through ports in fluid communication with the activation chamber (116), outside of the diaphragm (110).

At one end, discharge ports (130) through the mandrel are provided, which are in fluid communication with the pump outlet and the discharge passage (104) in the top flow sub (102). At the other end, suction ports (132) through the mandrel are provided, which are in fluid communication with the pump inlet and the intake passage (105) in the bottom flow sub.

In one embodiment, a top valve sub (117) includes assemblies of redundant check valves (118) employed at the outlet of the top flow sub (102) to ensure proper operation and isolation of the pump apparatus. Several check valves of different operating methodology are preferably employed in the check valve assembly (118) to eliminate single path failure mechanisms. For example, the top valve sub (117) may have a ball and cage valve and a flapper valve. A bottom valve sub (not shown) duplicates the valve assembly (120) at the intake end, but differs in that the pump intake is in fluid communication with the external environment, and not with the flow through passage (101). Accordingly, the pump when activated, adds to the flow in the flow through passage (101), while not exposing it to the reservoir.

When the pressure in the activation chamber exceeds the pressure in the production chamber, the diaphragm will collapse around and be supported by the transverse profile of the internal mandrel (122). Preferably, the circumference of the diaphragm (110) closely matches the length of the perimeter of the lobed profile, which results in the diaphragm matching the contours of the internal mandrel (122) when in its collapsed position.

The outer diaphragm support structure comprises the cylindrical pump housing (112), which supports the diaphragm (110) in its extended state, as is shown in FIGS. 22A, B and C. In the event of an over-pressurization of the pump outlet line, the external diaphragm support restricts the geometry of the diaphragm causing all applied pressure on the diaphragm in the expanded state to be borne by the rigid outer pump housing. This outer diaphragm support thus prevents the diaphragm from failing due to excessive pressures applied to the internal volume of the diaphragm material.

The capacity of the diaphragm pump is determined by the volume of the pump chamber, which of course depends on its length and the effective diameter of the inner and outer support structures, the difference between which defines the "stroke" of the pump. Accordingly, pumps having differing capacities may be designed for different pumping scenarios.

Figure 23:
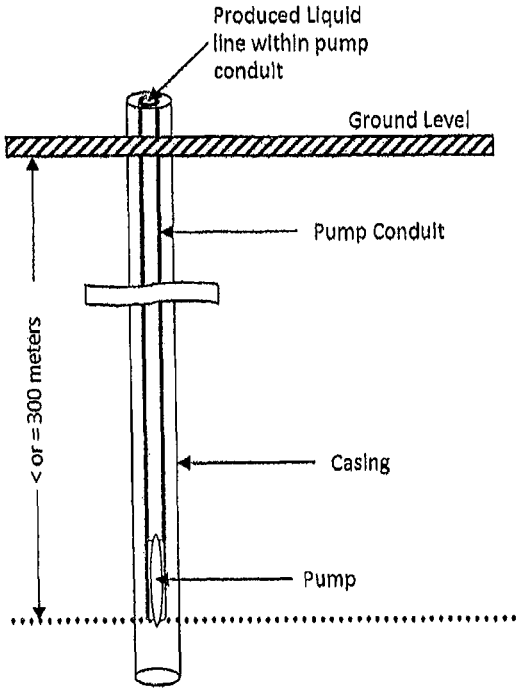
FIG. 23 shows a schematic representation of a single diaphragm pump installed in a vertical wellbore.

In this embodiment of a diaphragm pump, gas lift is provided in the form of the activation fluid. If applied to a vertical segment of the wellbore, and limited to 500 psi, this corresponds to approximately 341 meters of vertical lift for a column of water. A schematic of this type of pump configuration is shown below in FIG. 23. Even if the actual lift of a single pump stage is limited to 300 meters, it is possible to economically produce liquids through a larger vertical section by adding multiple pumps in series, as shown schematically in FIG. 24.

Figure 24:
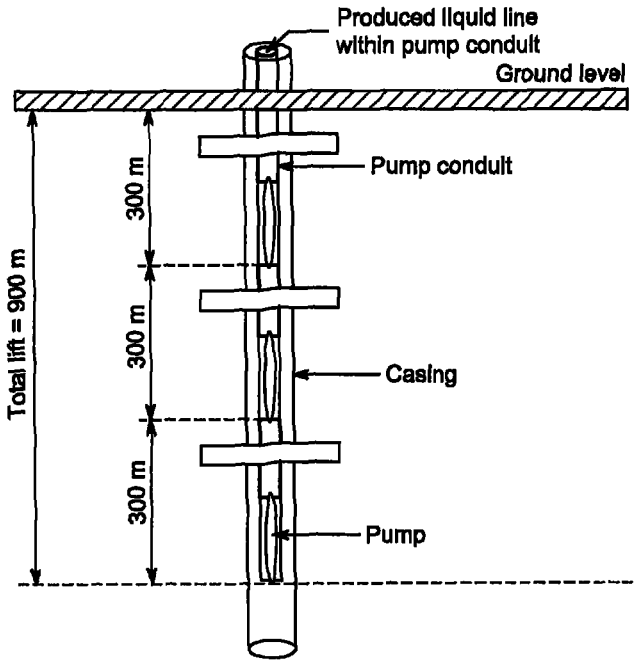
FIG. 24 shows a schematic representation of multiple diaphragm pumps installed in a vertical wellbore.
Figure 25:
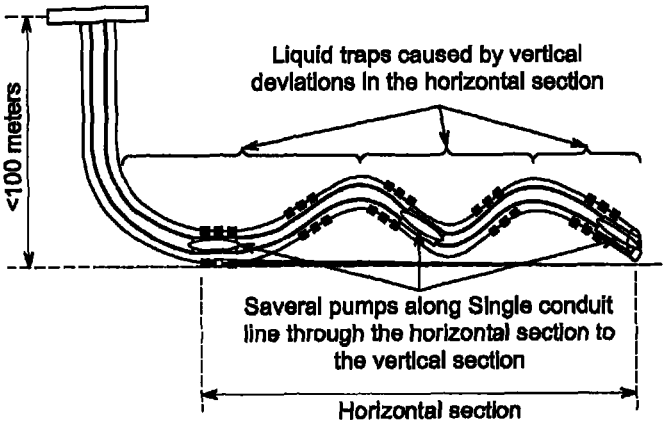
FIG. 25 shows a schematic representation of multiple diaphragm pumps installed in the horizontal segment of a wellbore.

By putting pumps in series, the maximum pressure seen by each pump can be controlled to limit the required gas supply pressure. A schematic of a pump system configuration with a staged vertical lift of 300 meters, and a total system vertical lift of 900 meters is shown in FIG. 24. The 900-meter total liquid lift height is achieved by putting 3 pumps in series with each pump providing 300 meters of total lift only. This system configuration reduces the problems associated with motive gas compression to high pressures by staging the total vertical lift over a series of vertical lift steps. Rather than requiring a high pressure to achieve the total lift in this scenario, a lower supply pressure is required with a somewhat larger volume flow rate due to the number of pumps required to achieve the total lift.

The horizontal pump solution does not see the same high pressures as the vertical type solutions. The liquid is lifted a total of 100 meters (or less) from the bottommost point, limiting the pressure required in the motive gas to approximately 150 psi. This lower pressure reduces the complexity of any surface compression system, as well as the volume of high pressure surface gas storage required.

FIG. 26 shows a pump system in a horizontal configuration, with pumps situated in parallel to each other (discharging produced liquids to a common manifold) to a maximum liquid height if 100 meters. The arrangement of an array of pumps in a parallel type configuration in the horizontal wellbore, in which a plurality of pumps force wellbore fluids into a single common outlet manifold may provide many operational benefits to the overall system, which have been described above.

Figure 29:
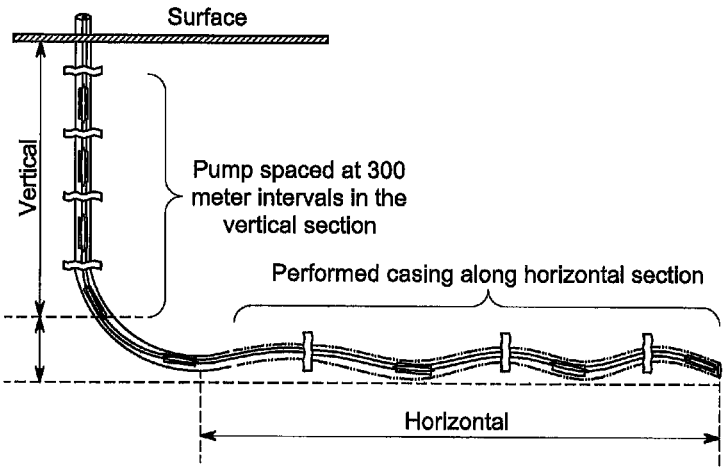
FIG. 29 shows one embodiment, where multiple diaphragm pumps are provided along both the vertical and horizontal segments of a wellbore.

In one embodiment, a combined hybrid horizontal/vertical lift system can be employed using a diaphragm pump (100) of the present invention in both the horizontal and vertical sections. This system would connect any number of pumps in a parallel configuration in the horizontal section, with any number of pumps in a series configuration in the vertical lift section of the wellbore. In the vertical section, pumps would be spaced at suitable intervals, for example at a maximum distance of 300 meters apart depending on pump capacity. The number of pumps required is directly related to the depth of the well. In the horizontal section, pumps are located to promote relatively uniform drawdown, and/or at any feature in the wellbore that will collect liquids and impede the flow of gas or oil through the interior space of the wellbore. A schematic diagram of this pump arrangement can be seen in FIG. 29.

In addition to a combined horizontal/vertical solution consisting entirely of diaphragm pumps in various configurations (series/parallel), the horizontal pumping system can be coupled with any other vertical lift solution that is well known to the art, such as those pumps described in U.S. Pat. No. 7,431,572 B2 and Canadian Patent No. 2,453,072. Any generic vertical lift system could perform the vertical liquid lift function, and the horizontal pump system of the present invention performs the horizontal fluid delivery function.

Figure 30:
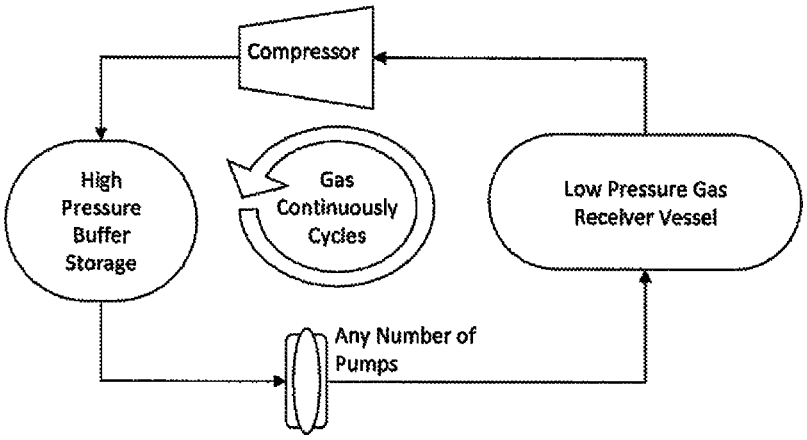
FIG. 30 shows a schematic representation of a pumping system of one embodiment of the present invention wherein the activation system is of closed loop design.

The pump system may be a closed loop system which cycles the activation gas in a continuous loop between high pressure and low pressure in order to activate the pump. The activation gas is pressurized in a compressor, stored in a buffer vessel at surface, injected into the pump annulus to initiate the pump stroke, vented into a low pressure gas exhaust return duct to surface, into the low pressure gas receiver at surface, and is recycled back into the inlet of the compressor. The closed loop gas cycling option uses one initial volume of gas that is endlessly recycled in order to provide the motive fluid for the multiple diaphragm pump system down-hole. A schematic diagram of the gas cycling in this style of system is shown in FIG. 30.

Figure 31:
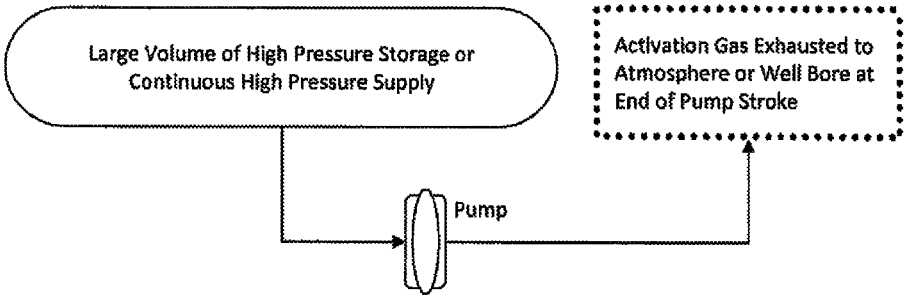
FIG. 31 shows an alternative embodiment of a pumping system. wherein the activation system is of open loop design
Figure 32:
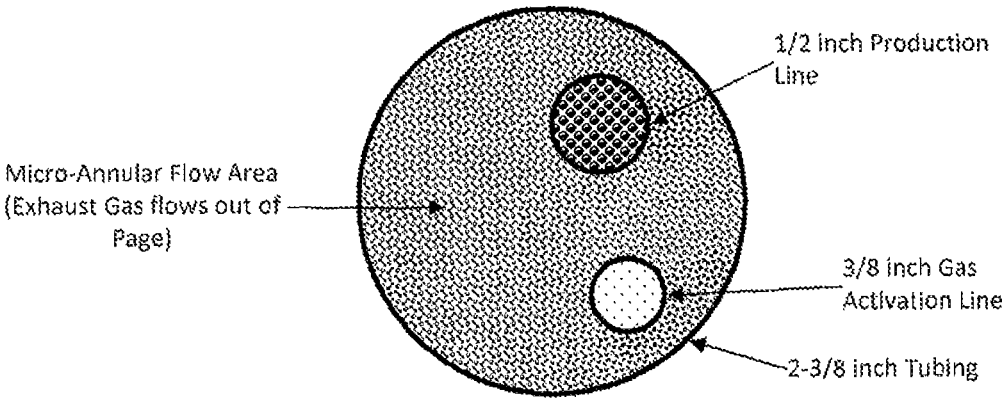
FIG. 32 shows a transverse cross-section of an alternative embodiment of an annular production/activation line.

The alternative to a system that continuously recycles the activation gas is a system that uses storage capacity at surface, or a continuous high pressure supply, to supply the activation gas to the pump system. This open-loop type system does not recycle the motive gas once it has been used in the pumping part of the pump cycle—the gas is simply exhausted into the wellbore or to surface and hence to atmosphere. A schematic diagram showing the open-loop style of system is shown in FIG. 31.

The activation gas discharge conduit may exist in different configurations in order to describe the necessary functions and operation of different line configurations. In one embodiment, the discharge line is provided in an annular activation/production line shown in FIG. 31. In this conduit configuration, the pump activation gas is exhausted into the indicated micro-annular cavity within the pump string. This exhausted gas is allowed to travel to surface where it flows as per either the open-loop or closed-loop system configuration. The large volume per unit length available in the micro-annular cavity will reduce the required volume of the low pressure exhaust gas receiver vessel on surface. The large volume per unit length available in the micro-annular cavity will reduce the pump intake stroke cycle time.

Figure 33:
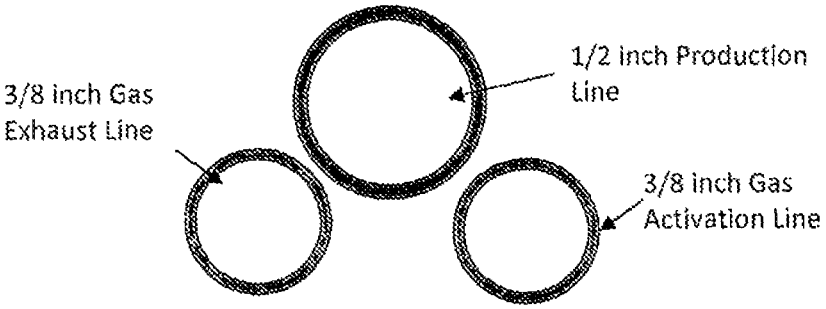
FIG. 33 shows a transverse cross-section another embodiment of adjacent production/activation lines.

An alternative conduit configuration, shown in FIG. 33, uses a dedicated exhaust line that runs from surface to the pump as a conduit for the exhausted activation gas. In this case, the exhausted gas is either recycled in a closed-loop style solution, or exhausted to atmosphere, or collected to be used for another purpose.

In the case where the activation gas is exhausted directly to the wellbore, it is not necessary to operate with an exhaust conduit through to surface. Short sections of conduit may be used to prevent the exhaust ports from becoming submerged within the column of fluid in the wellbore, but these would need to be just long enough to clear the liquid surface.

The activation fluid may comprise a gas such as carbon dioxide, natural gas, or nitrogen, or may comprise a hydraulic fluid such as water or a hydraulic oil.

As will be apparent to those skilled in the art, various modifications, adaptations and variations of the foregoing specific disclosure can be made without departing from the scope of the invention claimed herein.

What is claimed is:

1. A pump system for producing fluids from a reservoir using a wellbore having a vertical section with a casing defining a wellbore annulus and a horizontal section in fluid communication with the wellbore annulus, and a production tubing having a vertical section, a horizontal section and a toe end, the production tubing defining a continuous flow path from the toe end to the vertical section, the system comprising:

(a) a plurality of horizontal pumps operating in parallel in the production tubing horizontal section, each having an intake exposed to the reservoir and an outlet in the continuous flow path;

(b) wherein the continuous flow path is entirely isolated from the reservoir except through the horizontal pumps.

2. The system of claim 1 wherein the plurality of horizontal pumps comprises a diaphragm pump, an electric submersible pump, a hydraulic submersible pump, a jet pump, a pneumatic drive pump, a gas lift pump, a gear pump, a progressive cavity pump, a vane pump, or combinations thereof.

3. The system of claim 2 wherein each of the horizontal pumps comprises a diaphragm pump.

4. The system of claim 1, 2 or 3, further comprising a control system connected to each horizontal pump, which is operative to vary a pump rate of each pump independently.

5. The system of claim 4 further comprising at least one probe functionally associated with each of the horizontal pumps, for measuring and transmitting flow, pressure or temperature data to the control system.

6. The system of claim 4 further comprising a plurality of probes functionally associated with each of the horizontal pumps, for measuring and transmitting flow, pressure and temperature data to the control system.

7. The system of claim 1 wherein at least one horizontal pump is a redundant pump.

8. The system of claim 1 wherein two or more horizontal pumps are located in an isolated segment and have in common one suction inlet facing the reservoir.

* * * * *